United States Patent [19]

Buckens

[11] Patent Number: 4,623,877

[45] Date of Patent: Nov. 18, 1986

[54] METHOD AND APPARATUS FOR DETECTION OF TARGETS IN AN INTERROGATION ZONE

[75] Inventor: Pierre F. Buckens, Louvain-La-Neuve, Belgium

[73] Assignee: Knogo Corporation, Hicksville, N.Y.

[21] Appl. No.: 509,292

[22] Filed: Jun. 30, 1983

[51] Int. Cl.[4] ..... G08B 13/24

[52] U.S. Cl. ..... 340/572; 340/551

[58] Field of Search ..... 340/551, 572

[56] References Cited

U.S. PATENT DOCUMENTS

| | | | |
|---|---|---|---|
| 3,868,669 | 2/1975 | Minasy | 340/572 |
| 3,983,552 | 9/1976 | Bakeman et al. | 340/551 X |
| 4,309,697 | 1/1982 | Weaver | 340/572 |
| 4,326,198 | 4/1982 | Novikoff | 340/572 |
| 4,384,281 | 5/1983 | Cooper | 340/572 |
| 4,476,459 | 10/1984 | Cooper et al. | 340/572 |
| 4,524,350 | 6/1985 | Eccleston | 340/572 |

FOREIGN PATENT DOCUMENTS 763681 5/1934 France .

*Primary Examiner*—James L. Rowland
*Assistant Examiner*—Brian R. Tumm
*Attorney, Agent, or Firm*—Fitzpatrick, Cella, Harper & Scinto

[57] ABSTRACT

Targets (30) of readily saturable mangetic material and mounted on protected articles (14) are detected when taken through an interrogation zone (24) in which an alternating magnetic interrogation field is generated by transmitter antenna coils (42, 44). The target (30) is driven alternately into and out of saturation and it disturbs the alternating magnetic interrogation field in a manner so as to produce alternating magnetic fields at frequencies which are harmonics of the frequency of the alternating magnetic interrogation field. The composite of these alternating magnetic fields has a characteristic asymmetry due to the effect of the earth's magnetic field. The target responses are detected by receiver antenna coils (50, 52) to produce first detection signals which are processed in a compressor (118) and a signal averager (124) to produce asymmetry signals which are compared in a comparator (146) with the first detection signals to produce alarm signals.

62 Claims, 18 Drawing Figures

+10
+8
+6
+4
+2
0
-2
-4
-6
-8
-10
A
Interrogation Field
Saturation Point Of Target In Interrogation Field Only
Saturation Point Of Target In Both Interrogation Field And Earth's Magnetic Field
Earth's Magnetic Field
Time
Response Of Target To Interrogation Field
B
Response Of Target To Combined Effects Of Interrogation Field And Earth's Magnetic Field
C

METHOD AND APPARATUS FOR DETECTION OF TARGETS IN AN INTERROGATION ZONE

BACKGROUND OF THE INVENTION

1. Field of the Invention

This invention relates to the detection of targets in an interrogation zone and more paticularly it concerns novel methods and apparatus for identifying a characteristic signal produced by special magnetic targets mounted on books or merchandise as they are carried through an interrogation zone at the exit from a protected area.

2. Description of the Prior Art

French Pat. No. 763,681 dated May, 1934 discloses an electronic detection system for detecting the unauthorized taking of books or merchandise from a protected area. According to the French Patent the books or merchandise have affixed thereto "targets" in the form of a strip of a high magnetic permeability material characterized by magnetic saturation at low induction. One such material is known by the name of permalloy. As described in the French patent, transmitting and receiving antennas are set up at an exit from the protected area. The transmitting antenna is energized to generate an alternating magnetic interrogation field in an interrogation zone at the exit. When an article carrying a target is brought through the zone the alternating magnetic field drives the target into and out of magnetic saturation. The target in turn, produces characteristic electromagnetic disturbances in the form of pulses which are made up of harmonics of the magnetic interrogation field frequency. The receiving antenna is arranged to receive these pulses and a receiving apparatus is connected to the receiving antenna to respond to selected ones of the harmonic frequencies produced by the target.

A problem that occurs in a detection system of the type described above is that of discriminating between true targets and other pieces of metal or magnetic material that might be carried through the interrogation zone. In order to provide a magnetic interrogation field which is strong enough at a distance of, for example, two feet (60 cm.) or more from the interrogation antenna to drive the target into saturation, the magnetic field must be so strong in the immediate vicinity of the antenna that it will also drive many ordinary metal objects into saturation and cause them also to emit harmonics of the interrogation field frequency.

French Pat. No. 763,681 points out than by arranging, in the object which may be stolen, a magnetized metal part, one can detect the presence of this part by the harmonics of even rank which appear in such case. The same patent also suggests passing into the antenna a direct current superimposed on the alternating current to modify the initial permeability of the target. U.S. Pat. No. 4,326,198 also discusses the use of a separate bias field antenna next to the interrogation antenna to cause the target to produce even harmonics of the interrogating field frequency. The same patent further discloses that the earth's own magnetic field can be used to bias the target so that it will produce a predominance of even harmonic frequency components. U.S. Pat. No. 4,384,281 also discloses an electromagnetic type theft detection apparatus which incorporates signal gates and noise gates and comparison means for comparing signals of different frequencies and signals which occur at different times.

It so happens that the presence of the earth's magnetic field also causes ordinary metal objects to produce even harmonic frequency components when such objects are driven repetitively into and out of magnetic saturation. Accordingly, it is not always possible, simply by detecting only even harmonic frequencies, to distinguish between various metal objects and the targets themselves.

A further problem found in the prior art is that electromagnetic fields from other sources are present in the interrogation zone and these other fields can interfere with and overwhelm the fields produced by the targets. These other fields are random in amplitute, frequency and phase; and they are difficult to eliminate without eliminating the true target signals.

SUMMARY OF THE INVENTION

The present invention makes it possible to detect, with greater accuracy and sensitivity than heretofor possible, the signals produced by readily saturable magnetic targets; and to distinguish those signals from the signals produced by external sources as well as other metal objects which also may become saturated by the interrogation field.

According to one aspect of the invention the signals produced by a true target are separated from the signals produced by other sources; and this separation is carried out by detecting the magnetic fields in the interrogation zone and producing a corresponding first electrical signal whose amplitude varies according to the intensity of the magnetic fields in the zone. The first electrical signal is divided according to a series of successive time increments which occur in synchronism with the frequency of the interrogation field. Then the signal which occurs during each of a first group of successive time increments is compared with the signal which occurs during corresponding ones of each of a second group of successive time increments. The groups of time increments are also made to be in synchronism with the frequency of the interrogation field. Suitable means are provided for such detection, signal production and comparison. In this manner and with such means there is produced an alarm signal which is free of all variations which are not synchronously related to the interrogation field frequency.

Moreover, in this manner and with this means all external noises are cancelled while at the same time the full waveform of the target signal is preserved intact. That is, the full bandwidth of the target response is maintained. Other techniques used in the prior art to isolate target signals relied on the use of a bandpass or single frequency filter but in those cases a significant portion of the bandwidth of the target response was lost and accordingly much of the information which identified the target was also lost.

In a preferred embodiment of the invention, the corresponding ones of the first and second groups of time increments are separated in time by one-half period i.e. one-half cycle, of the interrogation field frequency. This time relationship results in the extraction of those voltage variations which correspond to pulses which are asymmetric in time, that is, those which do not occur in equally spaced intervals within each cycle of the interrogation field. Such pulses are particularly characteristic of readily saturable targets whose magnetic saturation is affected significantly by the earth's magnetic field as well as by the alternating magnetic interrogation field. Other metal objects, including those which may also become magnetically saturated by the interrogation field, are significantly less affected by the earth's magnetic field; and even though those elements may be driven into magnetic saturation by the interrogation field. The resulting voltage variations correspond to pulses which are more symmetric in time and which occur in more equally spaced intervals within each cycle of the interrogation field. Furthermore, by comparing the signals in time increments separated by one-half the cycle of the interrogation frequency, i.e. by scanning the time increments at twice the interrogation frequency, it is possible to reject approximately ninety percent of the effects of non linearities in the system components inasmuch as those non linearities produce effects that are highly symmetrical. Thus the detection arrangement of the invention simply ignores the signal components which are not characteristic of true targets without becoming blinded to those signal components which are characteristic of true targets.

According to another aspect of the invention, a uniform magnetic bias is maintained throughout the interrogation zone. This bias is preferably produced by the earth's magnetic field. An alternating magnetic field is also generated in the zone sufficient to drive targets in the zone alternately into and out of magnetic saturation so that they produce electromagnetic waves. First electrical signals are produced in response to the electromagnetic waves in the interrogation zone. These first electrical signals are processed to produce further signals corresponding to the effect of the magnetic bias; and the first and further signals are compared to produce an alarm. Suitable means are provided to receive the electromagnetic waves and convert them into said first electrical detection signals and further means are provided to produce the further signals, to compare the first and further signals and to produce an alarm.

In a preferred embodiment, the first signals are processed to produce further signals which correspond to the time asymmetry of the first signals. The term "asymmetry" as used herein means the amount by which the signal, during successive time increments in each half cycle of the interrogation field, deviates from being equal in amplitude and opposite in direction (relative to a given amplitude) to the signal during corresponding successive time increments in a preceding or succeding half cycle.

It has been found that the earth's magnetic field has a substantially greater influence, relative to the alternating magnetic interrogation field, in saturating a true target than it does in saturating other pieces of metal. It has also been found that when the effect of the earth's magnetic field in causing saturation of an object is high, so that the ratio of the effect of the earth's magnetic field to the effect of the alternating magnetic interrogation field is high, the resulting signals produced by the object are highly asymmetrical. Accordingly, by processing the signals to ascertain their asymmetry, it is possible to distinguish between signals produced by true targets and signals produced by other pieces of metal.

BRIEF DESCRIPTION OF THE DRAWINGS

A preferred embodiment of the invention has been chosen for purposes of illustration and description and is shown in the accompanying drawings forming a part of this specification wherein:

FIG. 3 is a diagrammatic perspective view showing the wiring of a transmitter antenna used in the antenna panel of FIG. 2;

FIG. 8 is a set of waveforms also used to explain the operation of the component represented in FIG. 7;

DETAILED DESCRIPTION OF THE PREFERRED EMBODIMENT

Figure 1:
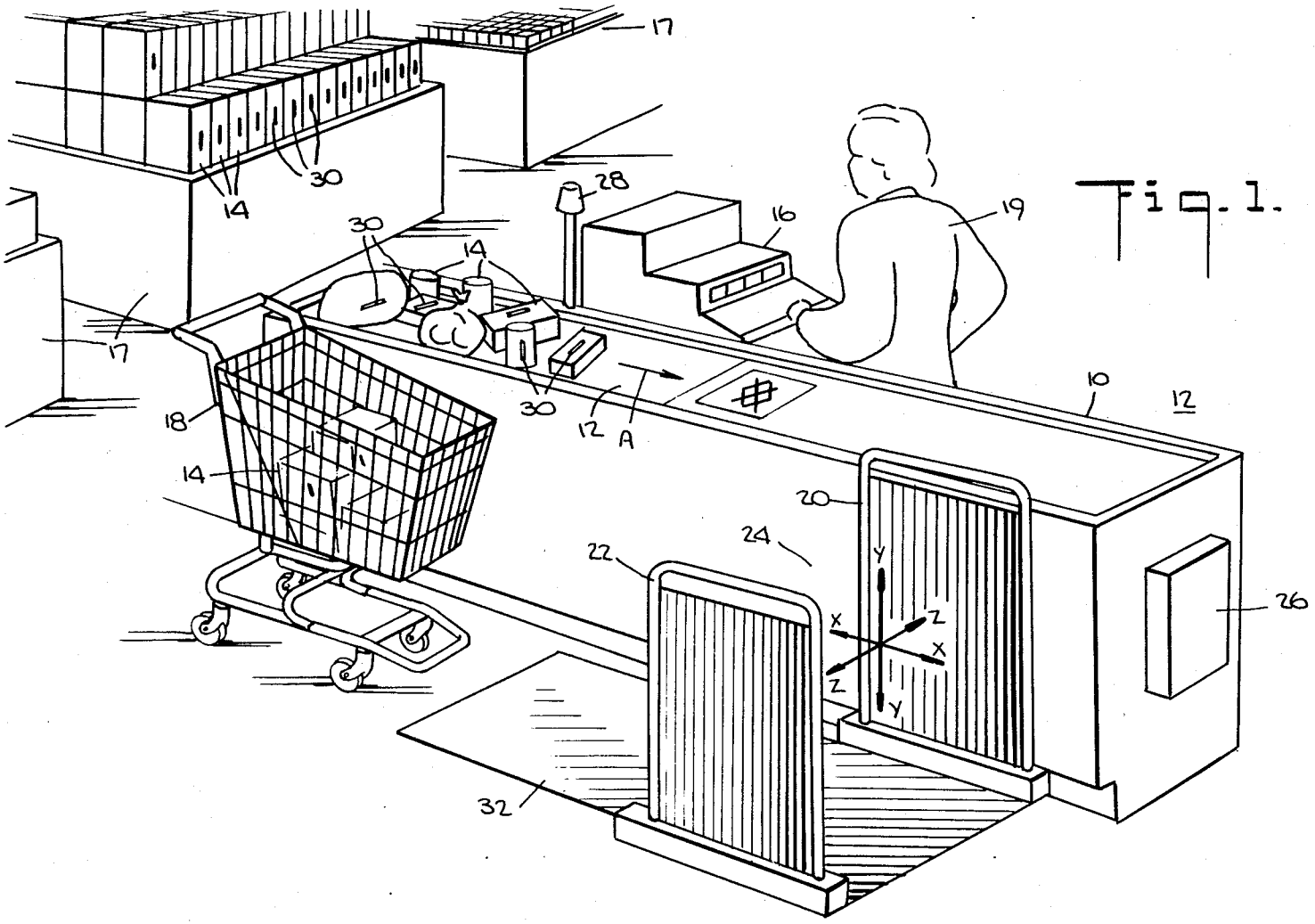
FIG. 1 is a perspective view of an electronic theft system embodying the present invention as installed in supermarket.

In FIG. 1 a theft detection system according to the present invention is shown as used in a supermarket to protect against theft of merchandise. As shown, there is provided a supermarket checkout counter 10 having a conveyor belt 12 which carries merchandise, such as items 14 to be purchased, (as indicated by an arrow A) past a cash register 16 positioned alongside of the counter. A patron (not shown) who has selected goods from various shelves or bins 17 in the supermarket, takes them from a shopping cart 18 and places them on the conveyor belt 12 at one end of the counter 10. A clerk 19 standing at the cash register 16 records the price of each item of merchandise as it moves past on the conveyor belt. The items are then paid for and are bagged at the other end of the counter. The theft detection system according to this invention includes a pair of spaced apart antenna panels 20 and 22 next to the counter 10 beyond the cash register 16. The antenna panels 20 and 22 are spaced far enough apart to permit the store patron and the shopping cart 18 to pass between them.

The antenna panels 20 and 22 contain transmitter antennas (described hereinafter) which generate an alternating magnetic interrogation field in an interrogation zone 24 between the panels. The antenna panels 20 and 22 also contain receiver antennas (also described hereinafter) which produce electrical signals corresponding to variations in the magnetic interrogation field in the zone 24. The antennas are electrically connected to transmitter and receiver circuits contained in a housing 26 arranged on or near the counter 10. There is also provided an alarm, such as a light 28, mounted on the counter 10, which can easily be seen by the clerk and which is activated by the electrical circuit when a protected item 14 is carried between the antenna panels 20 and 22. If desired, an audible alarm may be provided instead of, or in addition to, the light 28.

Those of the items 14 which are to be protected against shoplifting are each provided with a target 30 which comprises a thin elongated strip of a high permeability easily saturable magnetic material, such as permalloy. When the protected items 14 are placed on the conveyor belt 12 they pass in front of the clerk 19 who may record their purchase. The items 14 which pass along the counter 10 do not enter the interrogation zone 24 and they may be taken from the store without sounding an alarm. However, any items 14 which remain in the shopping cart 18, or which are carried by the patron cannot be taken from the store without passing between the antenna panels 20 and 22 and through the interrogation zone 24. When an item 14 having a target 30 mounted thereon enters the interrogation zone 24, it becomes exposed to the alternating magnetic interrogation field in the zone and becomes magnetized alternately in opposite directions and driven repetitively into an out of magnetic saturation. As a result, the target 30 produces unique disturbances in the magnetic field in the interrogation zone. These unique disturbances which are in the form of alternating magnetic fiedls at frequencies harmonically related to that of the interrgation field, are intercepted by the receiver antenna which produces corresponding electrical signals. These electrical signals, as well as other electrical signals resulting from the various magnetic fields incident upon the receiver antenna, are processed in the receiver circuits so as to distinguish those produced by true targets from those produced by other electromagnetic disturbances. Upon completion of such processing, the true target produced signals are then used to operate the alarm light 28. Thus the clerk 19 will be informed whenever a patron may attempt to carry protected articles out of the store without being purchased.

In the embodiment shown, the alarm system is normally in an "off" or inactive state. The system is put into an active state whenever a patron or a shopping cart 18 moves toward the interrogation zone 24. For this purpose there is provided a pressure sensitive mat 32 on the floor in front of the antenna panels. The mat is provided with a switch (not shown). When a patron or shopping cart 18 presses down on the mat 32, the mat switch is closed and places the system in its active condition in which the transmitting antennas generate an interrogating electromagnetic field between the antenna panels 20 and 22. As will be explained more fully hereinafter, the system remains in its active state while the patron or shopping cart is on the mat; and it continues to remain in its active condition for a duration of about 2.34 seconds thereafter, which is about the maximum length of time needed for a patron to walk between the antenna panels. After such time, the system reverts to its inactive condition.

The two antenna panels 20 and 22 are of similar construction and therefore only the antenna panel 20 will be described in detail. As shown in the exploded view of FIG. 2, the panel 20 comprises a hollow rectangular base 34 upon which is mounted a metal frame 36 in the shape of an inverted U. The base 34 may be of wood construction and it is approximately four and one-half feet long (1.4 m.) by six inches (15 cm.) high by four inches (10 cm.) wide. The metal frame 36 is about one inch (2.5 cm.) in cross section and is about four feet (1.2 m.) wide and four feet (1.2 m.) high.

Inside the frame 36 there is mounted an aluminum panel 38 which serves as a shield to prevent generated magnetic interrogation fields from extending over the counter 10. Thus the purchased items 14 can pass along the counter 10 without interaction with the magnetic interrogation field. A transmitter antenna support 40, which may be made of wood or similar material, is positioned within the frame 36 next to the aluminum panel 38 and on the side thereof facing the interrogation zone 24. An outer interrogation antenna coil 42 and an inner interrogation antenna coil 44 are mounted concentrically on the support 40. The outer antenna coil 42 is essentially square with rounded corners and is made up of approximately fifty turns of copper wire. The outer coil is approximately forty five inches (1 m.) high and forty five inches (114 cm.) wide. The inner antenna coil 44 is rectangular in shape an is also formed with rounded corners. The inner antenna coil 44 is also made up of several turns of copper wire. The inner antenna coil 44 has a length (i.e. horizontal dimension) of about forty inches (101 cm.) and a height of about twenty inches (50.8 cm.). These dimensions are merely preferred and are not critical. The interrogation antenna coils 42 and 44 are secured to the support 40 by means of insulative straps 46.

A receiver antenna support 48, which may be of wood, paperboard or other insulative composition, is mounted adjacent to the transmitter antenna support 40. A pair of receiver antenna coils 50 and 52 are mounted on the support 48 and are held in place with any suitable means such as tape 54. The receiver antenna coils 50 and 52 are each made up of twenty turns of 30 gage copper wire. The receiver coils are each of square configuration approximately thirty one inches (79 cm.) on each side. These dimensions are merely preferred and are not critical. The coils 50 and 52 are arranged in staggered overlapped array with one corner of one coil being located at the center of the other coil.

A cover 55 of insulative material is positioned over the receiver antenna coils 50 and 52.

Figure 2:
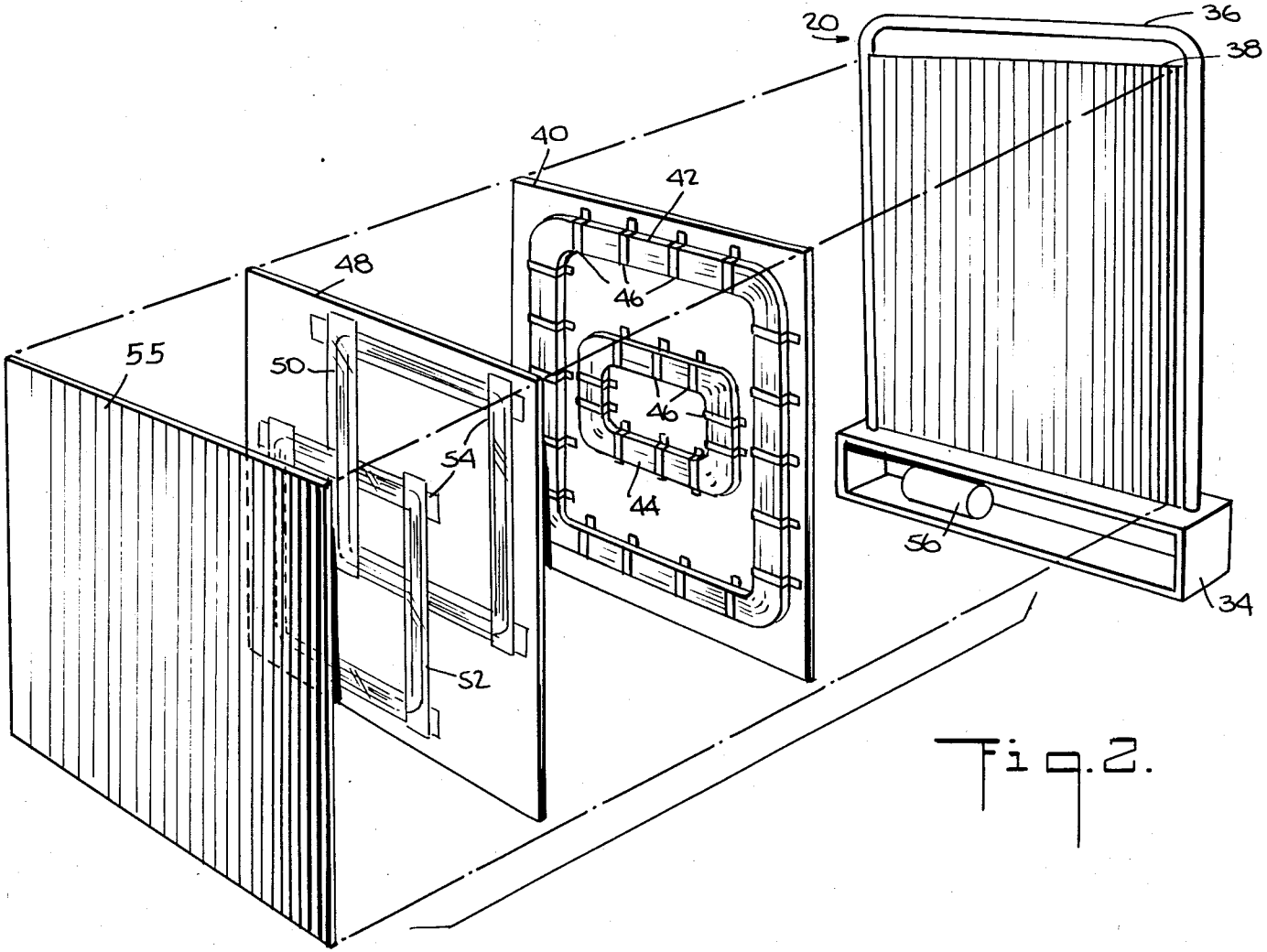
FIG. 2 is an exploded perspective view showing a portion of an antenna panel used in the theft detection system of FIG. 1.

As shown in FIG. 2, a transmitter antenna capacitor 56 is mounted in the hollow rectangular base 34. The base is closed by a suitable cover (not shown).

FIG. 3 shows the electrical coils 42 and 44 in the two antenna panels 20 and 22. As shown in FIG. 3, a lead 57 from a transmitter amplifier (not shown) divides at a junction **57*a* from where it branches to the two antenna panels 20 and 22. At each antenna panel the lead 57 divides again at a further junction 57*b* from which it branches to one end of each of the outer and inner transmitter antenna coils 42 and 44. The opposite end of each coil is connected to one side of the transmitter antenna capacitor 56. It will also be seen that the end of the inner transmitter antenna coils 44 connected to the capacitor 56** are also connected to ground.

In order to produce alternating magnetic interrogation fields of maximum effectiveness in the interrogation zone 24, i.e. fields which will be sufficiently strong to saturate the targets 30 for most position and orientations of the target in the interrogation zone, and without requiring an excessively large field in localized regions of the zone, the inner and outer coils in each panel are wound in relative directions so that the currents flowing through them in any instant are in the same direction, as shown by the arrows B in the panel 20. Also, the coils in the two antenna panels 20 and 22 are wound so that the currents flowing through the coils in one panel at any instant are of the same magnitude but are opposite direction from the currents flowing throught the coils in the other panel, as shown by the arrows B in the panel 20 and the arrows C in the panel 22. Thus, a person walking into the interrogation zone between the panels will first pass by the first vertical portions 42*a* and 44*a* of the coils 42 and 44 of each antenna panel. At the instant current is flowing upwardly in the first vertical portions 42*a* and 44*a* of the coils 42 and 44 in the left panel 22, current will be flowing downwardly in the first vertical portion 42*a* and 44*a* of the coils 42 and 44 in the right panel 20. By so energizing the antennas, the first vertical portions 42*a* and 44*a* of the coils in the two antenna coils cooperate to form, in effect, part of an antenna loop which encircles the interrogation zone, i.e. with an axis in the direction extending forwardly through the zone. This is shown as the X-axis in FIGS. 1 and 3. Likewise, the second vertical portions 42*b* and 44*b* of these same coils also cooperate to form, in effect, part of a similar antenna loop also with an axis coincident with the X-axis. It will be appreciated also that the resulting relationship of currents flowing through the upper horizontal portions 42*c* and 44*c* of the coils 42 and 44 in the two panels as well as of the currents flowing through the lower horizontal portions 42*d* and 44*d* of those coils is such that there are simulated portions of upper and lower horizontal coils having an axis in the vertical position. This is shown as the Y-axis in FIG. 2. This arrangement has been found to be very effective in providing a magnetic interrogation field which is adequate to drive the targets 30 into and out of magnetic saturation for most orientation and positions of the target as it is carried through the interrogation zone.

It will be seen in FIG. 3 that the coils 42 and 44 in each panel are connected in series with each other with the lead 57 from the transmitter amplifier connected to a junction between one end of each coil. The opposite ends of the coils are connected across the capacitor 56 to form a resonant loop.

Figure 4:
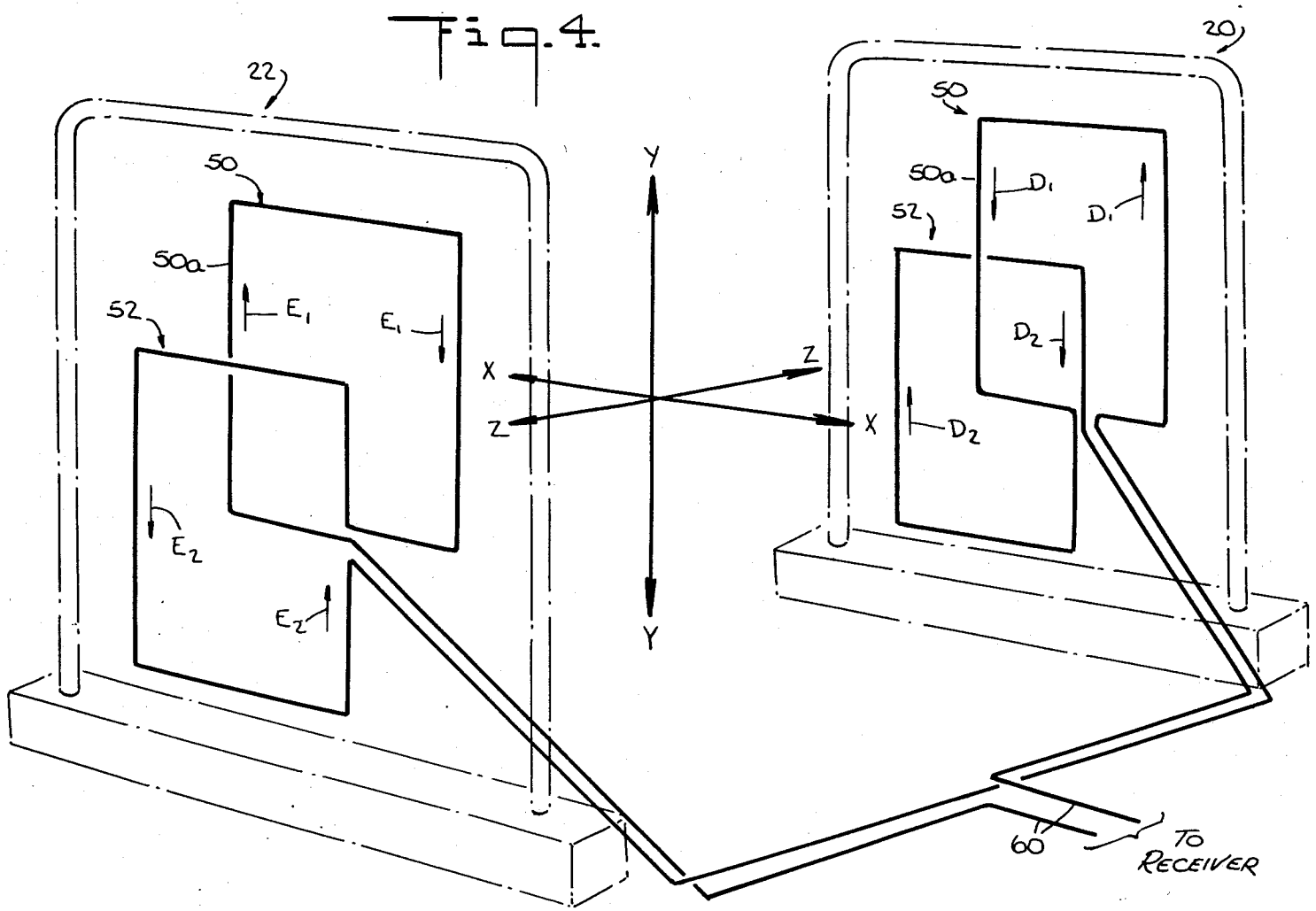
FIG. 4 is a diagrammatic perspective view showing the wiring of a receiver antenna used in the antenna panel of FIG. 2.

FIG. 4 shows the electrical connections for the receiver coils 50 and 52 in each of the antenna panels 20 and 22. As shown in FIG. 4, the coils 50 and 52 in each panel 20 and 22 are connected in series with each other; and the loops of each panel are also connected in series. The loops in each panel are also connected such that current flowing in one direction around the coil 50 in either panel will be accompanied by current flowing in the opposite direction is the other coil 52 as shown, for example, by the arrows D1 and D2 in the panel 20 and the arrows E1 and E2 in the panel 22. This produces a bucking effect which cancels, to a great degree, the currents induced in the receiver coils 50 and 52 by the transmitter coils 42 and 44 as well as currents induced in those coils by other remote electromagnetic sources. Currents induced by a target 30 passing through the interrogation zone, however, will not be cancelled because the target will always be closer to one loop than to the other.

It also will be noted that the loops 50 and 52 in the panels 20 and 22 are connected such that current flowing upwardly in the first vertical portion 50*a* of the loop 50 in one panel will be accompanied by current flowing downwardly in the corresponding vertical portion 50*a* of the loop 50 in the other panel. This arrangement permits the magnetic responses produced by a target 30 to combine additively so as to produce an electrical signal of maximum strength at the receiver. As shown in FIG. 4, the receiver loops 50 and 52 are connected via leads 60 to a receiver. The receiver itself is described hereinafter.

Figure 5:
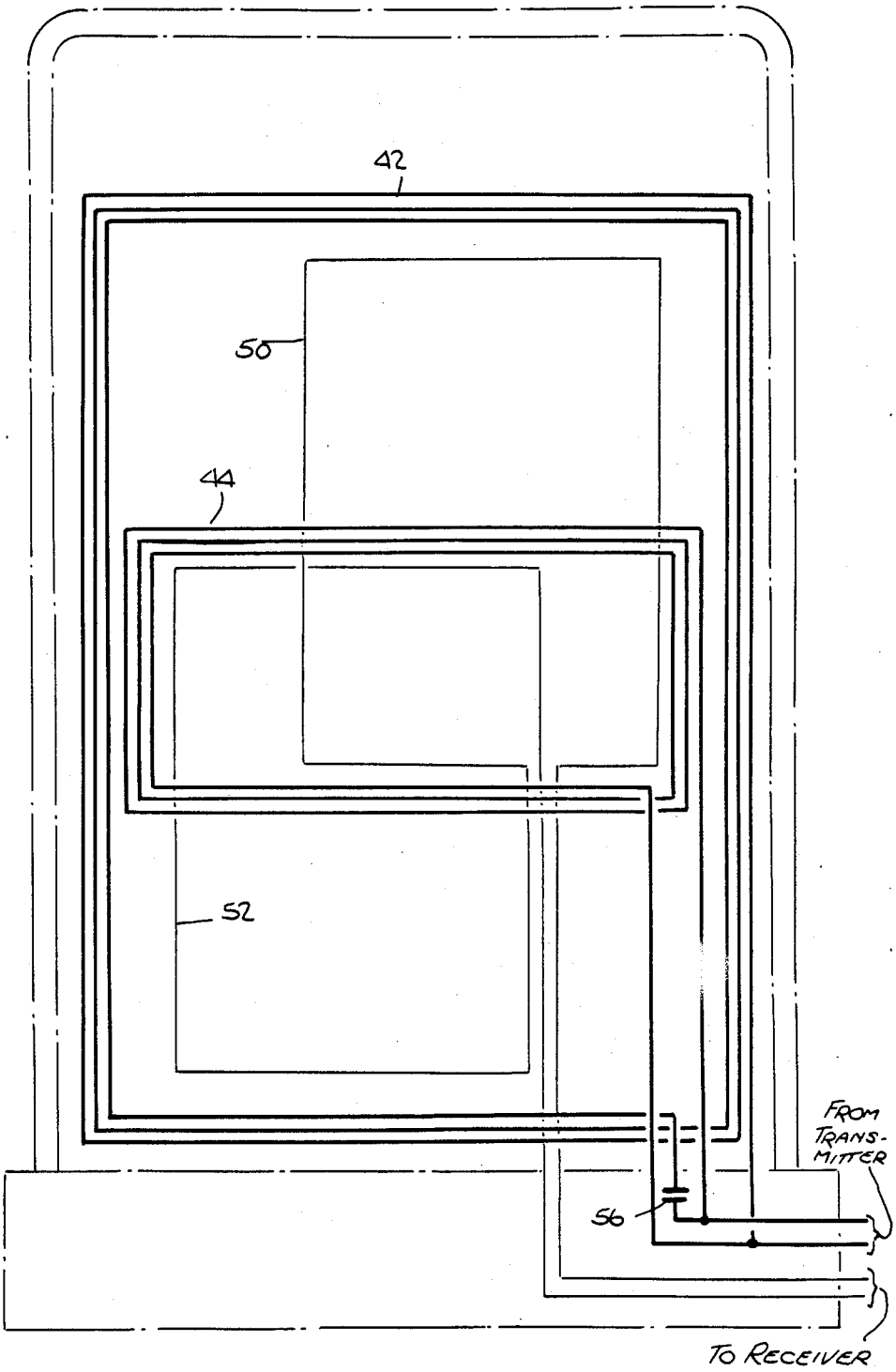
FIG. 5 is a diagrammatic elevational view showing the dimensional relationship between the transmitter and receiver antenna wiring in the antenna panel of FIG. 2.

The diagrammatic view of FIG. 5 shows that the receiver antenna coils 50 and 52 are dimensioned to fit just inside the outer interrogation antenna coil 42 and that the inner antenna coil 44 is dimensioned to extend nearly the full width of the antenna panel and to extend vertically to coincide with the upper horizontal portion of the lower receiver antenna coil 52 and the lower horizontal portion of the upper receiver antenna coil 50.

Figure 6A:
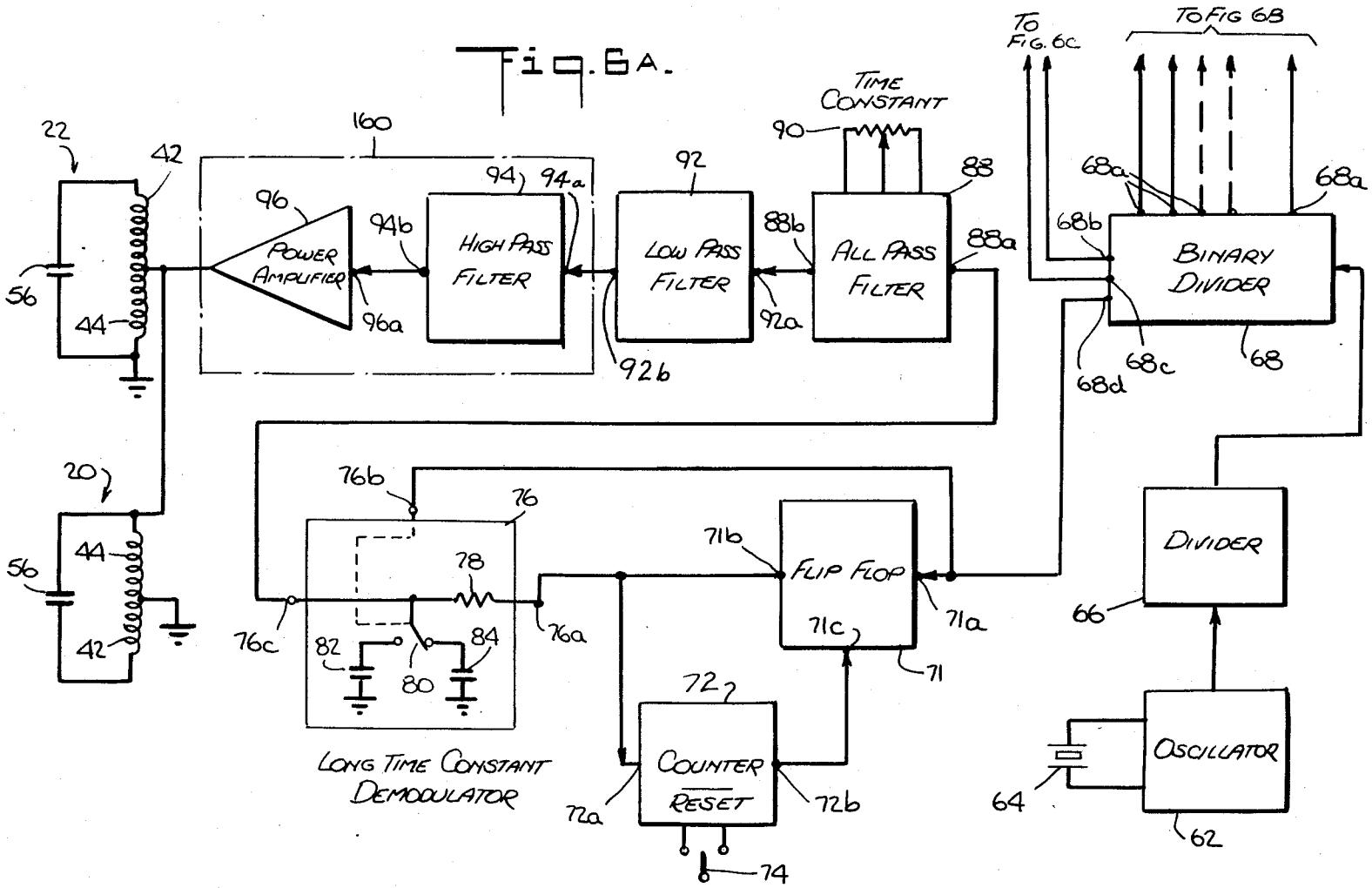
FIGS. 6A, 6B, 6C together form a block diagram showing the arrangement of components of the theft detection system of FIG. 1.
Figure 6B:
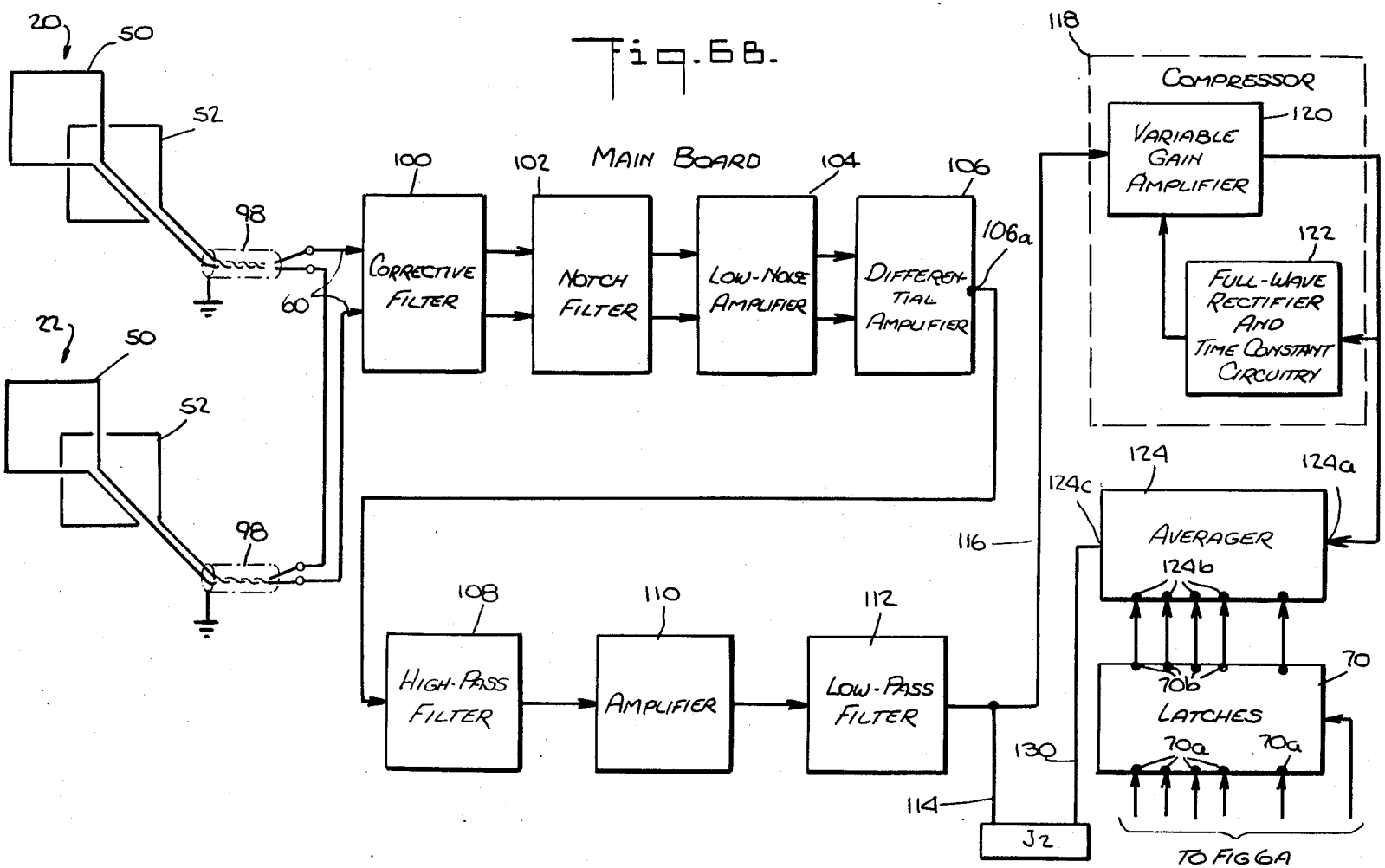
Figure 6C:
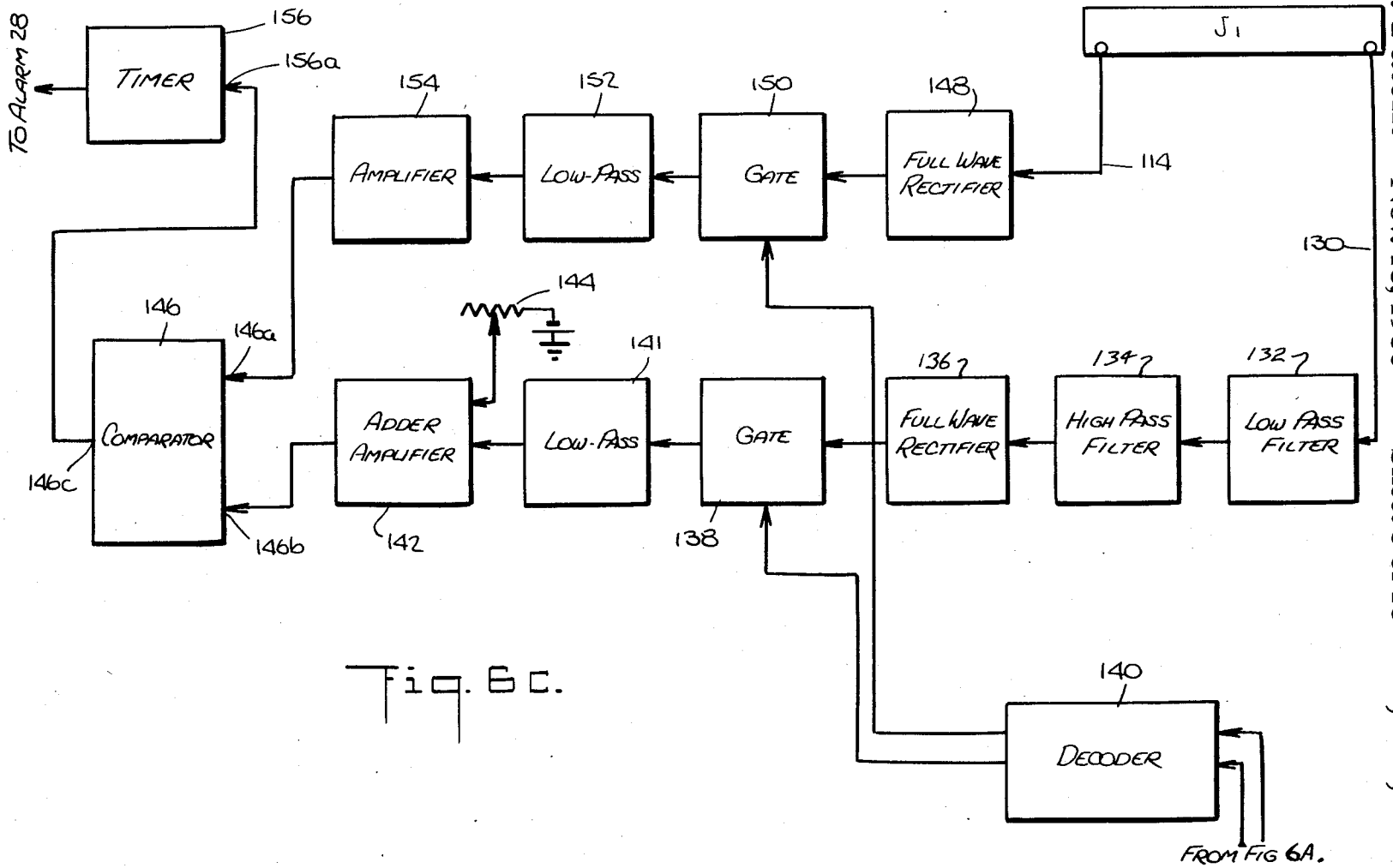

FIGS. 6A, 6B and 6C together show, in block diagram form, the electrical portions of the detection system. As shown in FIG. 6A, there is provided an oscillator 62 which is controlled by a crystal 64 to produce a continuous alternating electrical signal at a frequency of 168 KHZ (kilohertz). The output of the oscillator 62 is applied to a divider 66 which divides the applied frequency down to 21 KHZ. This divided down frequency is then applied to a binary divider 68. The binary divider is a counter type device which has forty eight scanner output terminals 68*a*. These scanner output terminals are sequentially energized in response to successive inputs received from the divider 66. The scanner output terminals 68*a* are connected to corresponding scanner input terminals 70*a* of an electrical latching circuit 70 shown in FIG. 6B. Thus, each scanner terminal 68*a* is energized every 2.28 milliseconds for a duration of 47.6 microseconds.

The binary divider 68 also produces decoding signals at gate terminals 68*b* and 68*c*. These terminals are also energized in timed relationship in response to inputs from the divider 66.

The binary divider 68 also produces signals at an interrogation control output terminal 68*d* at a rate equal to twice the interrogation frequency of the system, which, in the present embodiment, is chosen to be 218.75 HZ. Thus the output terminal 68*d* is energized at a rate of 437.5 HZ.

The output terminal 68*d* of the binary divider 68 is connected to an input terminal 71*a* of a flip-flop circuit 71. The flip-flop circuit 71 divides by two the signals applied at its input; and it produces at an output terminal 71*b*, a square wave signal at 218.75 HZ which shifts between positive five volts and negative five volts. The flip-flop circuit 71 also includes an inhibit terminal 71*c* which, upon receipt of an inhibit signal, causes the flip-flop circuit to produce a continuous zero voltage at its output terminal 71*b*.

The output terminal 71*b* of the flip-flop circuit 71 is connected to an input terminal 72*a* of a counter circuit 72. The counter circuit 72 divides the 218.75 HZ pulses by 512 to produce a frequency of 0.427 HZ (i.e. one pulse each 2.34 seconds), at a counter output terminal 72*b*. This counter output terminal is connected to the inhibit terminal 71*c* of the flip-flop circuit 71. A mat switch 74 is operated in response to pressure on the mat 32 (FIG. 1). The mat switch 74 is connected to the counter 72 to reset its count to zero when the mat switch is closed, as by a person or a shopping cart approaching the interrogation zone 24.

When the system is turned on, the flip-flop circuit 71 will produce square wave signals or pulses at 218.75 HZ for a duration of 2.34 seconds, at which time the counter circuit 72 will produce an inhibit signal at the inhibits terminal 71*c* of the flip-flop circuit 71 and will cause the circuit to discontinue producing the square wave signals. The system will remain in this inactive state until the mat switch 74 is closed by a patron or a shopping cart moving onto the mat 32. When this happens, the inhibit signal is removed from the flip-flop circuit 71 so that it begins again to produce square wave signals in response to pulses from the binary divider 68. The flip-flop circuit 71 will continue to produce these square wave signals as long as the mat switch 74 is closed and for a duration of 2.34 seconds after the switch is opened. This will ensure that the square wave pulses will continue for at least the length of time required for a patron to walk between the panels 20 and 22.

The mat switch arrangement serves to keep the system from generating magnetic interrogation fields except when a patron is about to pass between the panels 20 and 22. This reduces the potential effect of the system on people wearing heart pacemakers who may be in that vicinity of the system. It will be appreciated that the system may be arranged to operate continuously either by closing the mat switch 74 or by disconnecting the counter circuit 72 from the inhibit terminal 71*c* of the flip-flop circuit 71.

The output terminal 71*b* of the flip-flop circuit 71 is also connected to an input terminal 76*a* of a long time constant demodulator 76. The long time constant demodulator serves to cause the square wave signal supplied from the flip-flop circuit 71 to diminish gradually from full value (i.e. plus five volts and minus five volts) to zero when the flip-flop circuit becomes inhibited; and to increase gradually from zero to full value when the flip-flop circuit goes back into operation. As shown, the demodulator 76 has a switching terminal 76*b* which is connected to receive the 437.5 HZ pulses from the binary divider 68. As represented schematically, the demodulator 76 contains a resistor 78 connected between its input and output terminals 76*a* and 76*c* and a switch 80 arranged to connect the resistor alternately to two grounded capacitors 82 and 84 in response to signals applied to the switching terminal 76*b* from the binary divider 68. The switch 80, is operated at twice the frequency of, and in synchronism with, the square wave pulses applied to the input teminal 76*a*. As a result, the resistor 78 is connected to the capacitor 82 during the positive portions of the input pulses and to the capacitor 84 during the negative portions of those pulses. Now when the flip-flop 71 begins to produce square wave output pulses at positive five volts and negative five volts, the positive and negative portions of those pulses are applied via the resistor 78 to the capacitors 82 and 84 respectively. The capacitors thus gradually accumulate a charge so that the signal appearing at the output terminal 76*c* gradually increases from zero to positive five volts and negative five volts as the capacitors 82 and 84 acquire a charge. Conversely, when the flip-flop is inhibited to produce a continuous zero output, the switching of the switch 80 between the two capacitors 82 and 84 causes them to continue to supply a gradually decreasing square wave signal to the output terminal 76*c*.

It has been found that by causing the signals from the flip-flop circuit 71 to build up and diminish gradually, a number of potential bad effects are avoided. Firstly, an abrupt change in amplitude produces undesireable side band frequencies. The impedance of the interrogation antenna is highest at the 218.75 HZ interrogation signal frequency but is much lower at other frequencies. Thus any sideband frequencies could overload the amplifiers which drive the interrogation antenna. Secondly, the sideband frequencies could have adverse effects on the receiver portion of the system. Finally, abrupt changes in amplitude of the interrogating magnetic field can have adverse effects on pacemakers. These potential disadvantages are avoided by the long time constant demodulator 76 which smooths all amplitude changes as the flip-flop 71 is switched on and off.

The output terminal 76*c* of the long time constant demodulator 76 is connected to an input terminal 88*a* of an all-pass filter 88. The all-pass filter is provided with a potentiometer type time constant adjustment 90 which can be shifted to adjust the phase of the fundamental sine wave contained in the square wave signal at an output terminal 88*b* relative to the phase of the square wave signal applied to its input terminal 88*a* without, however, changing the amplitude of that signal. This permits adjustment of the phase of the electromagnetic interrogation signal produced in the interrogation zone 24. It will be appreciated that the phase of the target signals detected in the system becomes shifted as they are processed in the system. In order to be sure that the processed signals are in proper phase relation with the various gates and comparison means used in the system, the time constant adjustment 90 can be used to adjust this phase without changing the amplitude of the interrogation signal.

The output terminal 88*b* of the all pass filter 88 is applied to an input terminal 92*a* of a low pass filter 92. The low pass filter 92 is preferably a flat, sixth order Butterworth type filter; and it serves to extract from the 218.75 HZ square wave signal only the fundamental sine wave at 218.75 HZ, thus also rejecting the odd harmonic frequency components, e.g. 656.25 HZ, 1,093.75 HZ, 1,531.25 HZ, etc. Signals from true targets include harmonics at these frequencies; and their elimination from the interrogation signals, minimizes the chances of their being processed in the system as target signals. Also, these "side band" frequencies would overload the power section of the system.

The low pass filter 92 produces its filtered output at an output terminal 92*b*. This terminal is connected to an input teminal 94*a* of a high pass filter 94 which removes from the 218.75 HZ signal any direct current or low frequency components that may be present in the signal. Direct current components may be introduced by the various circuits; and low frequency components may be introduced by internal or external sources, e.g. the 50 or 60 HZ power supply. The high pass filter 94 may be a simple R-C (resistor-capacitor) high pass filter.

Outputs from the high pass filter 94 appear on an output terminal 94*b* and are applied to an input terminal 96*a* of a power amplifier 96. The power amplifier 96 amplifies the sine wave signal from the high pass filter 94 and applies it to the interrogation antenna coils 42 and 44 in each of the panels 20 and 22. The power amplifier 96 is preferably of push-pull output configuration and should be capable of delivering approximately sixty to one hundred watts of power to the interrogation antenna coils. The power amplifier should have high current capability because the impedance of the interrogation antenna decreases sharply at frequencies other than the 218.75 HZ interrogation frequency. Also, the power amplifier should have highly linear gain in order to avoid production of harmonic frequencies.

As can be seen in FIG. 6A, the antenna coil 44 in each panel 20 and 22 is connected between the output of the power amplifier and ground; and in each case the coil 44 is connected with the coil 42 and the capacitor 56 to form a resonant circuit loop with the capacitor connected in parallel with the coils 42 and 44. The inductance of the coils and the capacitance of the capacitor are chosen such that together they form a resonant circuit which resonates at the transmitter frequency, i.e. 218.75 HZ. The capacitor 56 may also be connected in series with the antenna coils 42 and 44 but the parallel connection is preferred because any non-linearities in the circuit will not affect the flow of current in the coils and would be absorbed by the amplifier. A series connection presents a minimum impedance at tuning and, in order to match that impedance to the characteristics of a semiconductor amplifier it would be necessary either to use a very high value of inductance (which necessitates a hazardous high voltage across the coil and presents an electrical insulation problem) or to use an impedance adapting transformer which would introduce inevitable non linearities and corresponding undesired harmonics.

Turning now to FIG. 6B, it will be seen the receiver antenna coils 50 and 52 in each panel 20 and 22 do not have a capacitor connected to them and accordingly these coils do not have a resonance or frequency sensitivity in the range of the transmitter frequency or in the range of target signals to be detected. As will be seen, the system of the preferred embodiment is arranged to detect target produced signals which include components up to the forty eighth harmonic, of the transmitter frequency, i.e. 10.5 KHZ. The distributed capacitance between the turns of the receiver antenna coils gives those coils a much higher resonance frequency, i.e. about 100 KHZ, so that the response of the receiver coil is essentially unaffected by the different frequency components of the signals being detected.

Because the coils 50 and 52 in each panel are wound in opposite directions they will produce mutually cancelling currents in response to magnetic fields applied equally to each coil. Thus the receiver coils are essentially unaffected by the fields generated from the transmitter coils 40 and 42. However, as a target 30 is carried between the panels 20 and 22, the target will, at each instant during its passage, be closer to and will exert more influence on one receiver coil than on the other. Because of this the currents induced in the coils 50 and 52 by a target being carried through the interrogation zone 24 will be unequal; and a net current will be generated across the receiver antenna leads 60.

As shown in FIG. 6B the receiver antenna leads 60 are twisted together and they extend through a grounded casing 98 between the receiver antenna coils, 50 and 52, and the receiver circuits. This serves to minimize the coupling of inductively and capacitively induced electrical noise into the system.

The receiver antenna leads 60 are connected to a corrective input filter 100. The corrective input filter serves to produce a flat frequency response characteristic over the range of target produced frequency components to be processed in the system, namely 1 KHZ to 10 KHZ. This filter also helps to reduce the amplitude of the fundamental transmitter frequency, i.e. 218.75 HZ and the lower harmonics up to 1 KHZ; and it also attenutates high frequency noises, such as from radio transmitters, that could drive some of the receiver components into saturation.

The output of the corrective filter 100 is supplied to a notch filter 102 which is sharply tuned to remove the fundamental transmitter frequency (218.75 HZ) from the incoming signal. Even with careful positioning of the oppositely wound receiver coils 50 and 52 relative to the transmitter coils 42 and 44, a residual component of the transmitter frequency is produced which is much larger in amplitude than the target produced signals. The notch filter 102 serves to block this residual component of the interrogation field.

The output of the notch filter 102 is applied to a low noise amplifier 104 which is matched to the receiver antenna coils 50 and 52 to provide maximum signal to noise ratio and gain. The receiver antenna coils operate as a low voltage, low inpedance signal generator and accordingly the amplifier 104 has a low impedance input for maximum power transfer while being configured to sustain only low voltage amplitudes at its input. Preferably, the amplifier 104 is a common base transistor amplifier.

The output of the low noise amplifier 104 is supplied to a differential amplifier 106. As can be seen in FIG. 6B, the ends of the receiver antenna coils 50 and 52, are connected as a differential input to the filter 100 and the filters 100 and 102 are connected to provide a differential input to the complifier 104. This isolates the system from common mode induced voltages with respect to ground. The differential amplifier produces, at an output terminal 106*a*, an output voltage which varies relative to ground in proportion to the differential voltage applied to its input.

The output from the differential amplifier 106 is applied to a high pass filter 108. This filter attenuates frequency components below 2 KHZ. The frequency components of the target produced signals below 2 KHZ are not significantly distinct from those produced by other metal objects which may become magnetically saturated by the interrogating field in the zone 24. However, the frequency components of the target produced signals above 2 KHZ are significantly distinct from components at those frequencies produced by other metals upon saturation. Thus the high pass filter 108 allows the system to consider those frequency components which are more characteristic of targets than of common metals. In addition, the high pass filter 108, by eliminating frequency components below 2 KHZ, reduces the range frequency components to be processed in the receiver and thus avoids problems which may otherwise occur when the processed signals exceed the dynamic range of the system components.

All of the filters in the receiver are optimized for phase linearity. Although such filters do not have as sharp an attenuation slope as other types of filters, e.g. Butterworth filters, such filters do produce a phase shift or delay which is more linearly related to frequency than other filters and this characteristic minimizes spreading in time of the sharp pulses produced by the targets.

The output of the high pass filter 108 is connected to an amplifier 110 which restores to the signals the amplitude which was lost in the high pass filter 108.

The signal from the amplifier 110 is applied to a low-pass filter 112. This low pass filter serves as an anti-aliasing filter to permit the succeeding circuits to process the signals without producing unwanted additional frequency components. The filter 112 is a five pole transitional filter having a cut-off frequency of 8.7 KHZ and providing 20 dB of attenuation at frequencies above 16 KHZ. The pole locations of this transitional filter are half way between those of a Bessel filter and those of Butterworth filter.

The output of the low pass filter 112 is applied to a first channel line 114 which leads to additional signal processing circuits to be described hereinafter. The output of the low pass filter 112 is also applied via a second channel line 116 to the input of a signal compressor 118. The signal compressor 118 comprises a variable gain amplifier 120 as well as a full wave rectifier and a time constant circuit 122. The compressor serves to produce output signals whose peak amplitude varies only minimally with large peak to peak amplitude variations of applied signals from the low pass filter 112. One purpose for this is to reduce the dynamic range of the signals applied to the succeeding signal processing circuits. A second purpose, as will be explained more fully hereinafter, is to permit the succeeding signal processing circuits to produce outputs which are more nearly proportional to the asymmetry of selected signals received from low pass filter 112.

The gain of the variable gain amplifier 120 is inversely proportional, within preselected threshold limits, to the amplitude of the incoming signal. The upper limit of gain is set to be below that which could cause amplification of residual noise sufficient to produce ambiguities in the succeeding circuits. The lower limit of gain is unity which prevents the amplifier 120 from operating as an attenuator. The variable gain amplifier 120 incorporates a field effect transistor whose source to drain channel resistance is used in the feedback loop of a conventional amplifier. The source to drain resistance is a function of the gate to drain voltage so that as the gate to drain voltage increases, the gain of the amplifier decreases. This relationship however is not linear but presents a "knee" above which gain control takes effect, and a saturation point above which control loses effect.

The output of the variable gain amplifier 120 is applied to the full wave rectifier and time constant circuit 122. The rectified output of this circuit is applied to the gate of the field effect transistor in the variable gain amplifier. In order to prevent saturation of the variable gain amplifier, which may occur as a result of the time delays which occur in filtering the rectified signal, the rectifier and time constant circuit 122 is arranged as a peak detector. That is, a very short time constant is provided for rising changes and a longer time constant is provided for falling changes. Thus the direct current voltage rises instantaneously with rising changes in input amplitude but it falls more slowly following falling changes in input amplitude. The time constant associated with the slowly falling change minimizes distortion. In the preferred embodiment, the time constant for rising signals is less than one microsecond while the time constant for falling signals is greater than one hundred milliseconds which is several times longer than the period of one cycle of the interrogation frequency.

The signals from the signal compressor 118 are applied to a signal input terminal **124*a* of an averager 124. The averager 124 also contains forty eight scanner input terminals 124*b* at which it receives signals from corresponding scanner output terminals 70*b* of the latching circuit 70. As pointed out above, the latching circuit 70 receives scanning signals from the binary divider 68 (FIG. 6A) in the form of pulses applied sequentially to its various scanner input terminals 70*a*; and it ensures that the signal changes at its terminals (which are connected to the scanner input terminals 124*b* of the averager 124**) occur in proper synchronism with each other, so that concurrently with the removal of a switching signal from one terminal, another switching signal is applied to another terminal.

The forty eight scanner input terminals of the averager 124 are each connected to corresponding switches within the averager and each switch in turn connects an associated capacitor between a common signal line and ground. The common signal line line extends between the input terminal **124*a* and an output terminal 124*c*** of the averager.

The signal averager 124 serves two functions. First, it eliminates from the applied signals all variations which are not synchronous with, or harmonically related to, the transmitter frequency. Second, it eliminates from the applied signals those portions which are symmetrical, i.e. which are equal in magnitude and opposite in direction in corresponding time segments within successive half cycles or half periods of the transmitter frequency. Since true targets produce only signals which are synchronous with the transmitter signal, the elimination of all non synchronous signals will enhance the true target signals. Also, because the earth's magnetic field has a much greater effect on the magnetic saturation of true targets than it has on other pieces of metal, and because the high relative effect of the earth's magnetic field on magnetic saturation produces a correspondingly high amount of signal asymmetry, the elimination of the symmetrical portion of the signal further enhances the detection of true targets.

Figure 7:
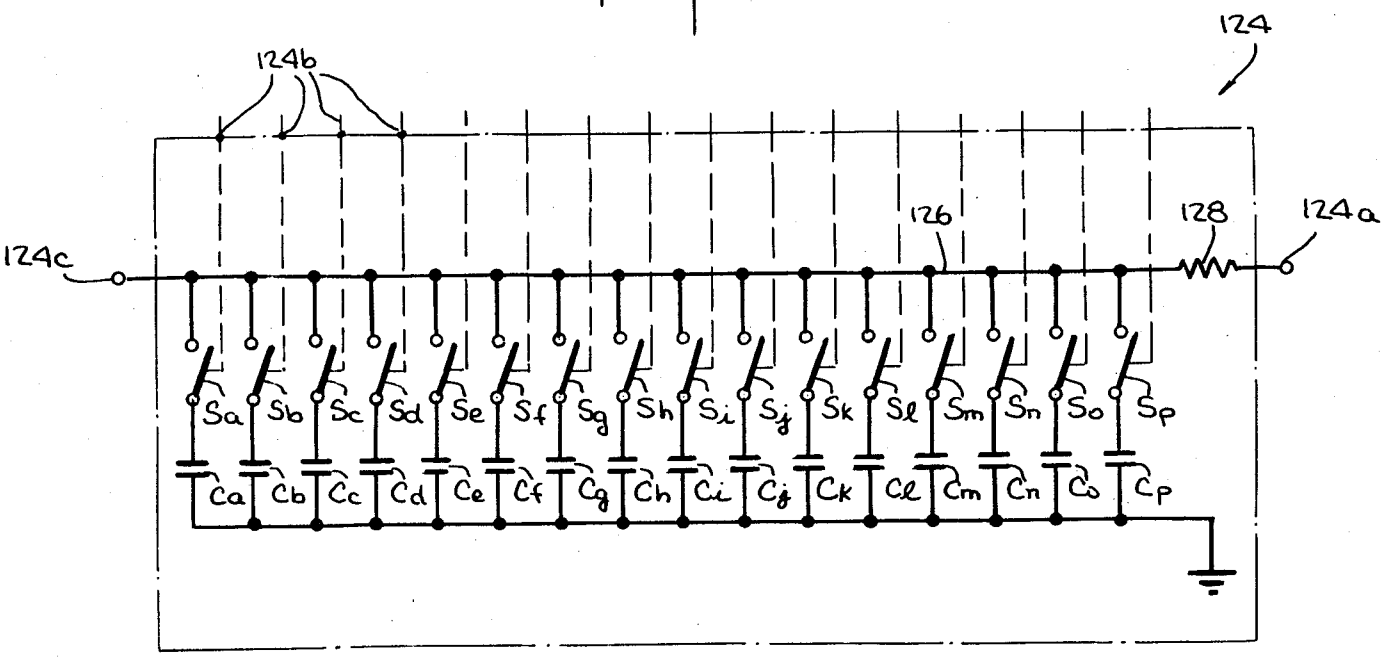
FIG. 7 is a schematic circuit diagram used to explain the operation of one of the components shown in FIG. 6.

To explain the operation of the averager 124, reference is made to FIGS. 7 and 8. In FIG. 7 the averager 124 is shown, for purposes of simplicity, with only sixteen scanning input terminals **124*b* which are connected to close normally open associated switches Sa . . . Sp when energized as previously described. Although the averager 124 in the preferred embodiment has forty eight scanning input terminals, any number may be used; but the more terminals that are used the more accurate will be the resulting output from the averager. Only sixteen terminals are shown in FIG. 7** because of drawing space limitations and because that number is sufficient for explaining the principles of the device.

As seen in FIG. 7, the switches Sa . . . Sp are arranged so that when closed they connect associated capacitors Ca . . . Cp between a common signal line 126 and ground. The input terminal **124*a* is connected via a resistor 128 to the common signal line 126, which in turn is connected to the output terminal 124*c***.

As pointed out previously, the forty eight output terminals **68*a* of the binary divider 68 (FIG. 6A) are energized in succession each for a duration of 47.6 microseconds so that the entire forty eight terminals are energized in a time span of 2.28 milliseconds, which is one half the period of the transmitter frequency. As these terminals are energized, they operate through the latches 70 and their terminals 70*b* to energize the associated scanner input terminals 124*b* of the averager 124. As each terminal 124*b* is energized it connects its associated capacitor between the signal line 126** and ground so that the capacitor receives a charge corresponding to the mean value of the synchronous applied signal at the instant the capacitor is connected to the signal line.

In the illustrative arrangement of FIG. 7, where, for purposes of simplicity, only sixteen scanner input terminals **124*a* and associated switches Sa . . . Sp and capacitors Ca . . . Cp are shown, each teminal 124*b*** would be energized for a duration of 142.8 microseconds so that the sixteen terminals will be energized in the time span of 2.28 milliseconds, i.e. one half the period of the 218.75 HZ transmitter frequency.

Turning now to FIG. 8 there is shown a sine wave (curve A) which represents the amplitude variation with time, of a signal at the interrogation or base frequency (i.e. 218.75 HZ). The time coordinate of this sine wave is divided into successive groups of sixteen time increments $a_0 \ldots p_0$, $a_1 \ldots p_1$, $\ldots a_2 \ldots p_2$, of 142.8 microseconds each. The total duration of each group of sixteen time increments is 2.28 milliseconds which is the period of one half cycle of the interrogation or base frequency. During each time increment the associated capacitor Ca . . . Cp (FIG. 7) is connected to the signal line 126 and will start to charge toward the voltage present on the signal line 126 at that instant. Thus if the sine wave representing the interrogation or base frequency is applied to the input terminal 124*a* and is impressed on the signal line 126 in synchronism with the application of switch closing signals to the terminals 124*a* the capacitors Ca . . . Cp will, after a time span of 2.28 milliseconds, start to charge in a manner representative of the different values of one-half cycle of the interrogation signal sine wave. For example, as repesented in FIG. 8, during the half cycle which occurs during the intervals $a_0 \ldots p_0$, the capacitors start to charge toward values which vary from −10 for capacitor Ca to +10 for capacitor Cp; and the composite voltage pattern on the capacitors is the same as that of the half sine wave A which extends over those intervals. After the charging process which takes place during each 142.8 microsecond duration, the switch opens and the capacitor preserves the built-up charge until the next half cycle when the switch closes again.

Now, during the next successive half cycle or half period of the interrogation or base frequency sine wave, the energization of the terminals 124*a* is repeated and the capacitors Ca . . . Cp are successively reconnected to the signal line 126 during the time periods $a_1 \ldots p_1$, respectively. During each time increment $a_1 \ldots p_1$; however, the value of the signal on the signal line 126 is equal in magnitude and opposite is direction to the value during the corresponding preceeding time increment. For example as represented in FIG. 8, the signal value at time increment $e_0$ is −7 whereas the value at time increment $e_1$, is +7. Thus, the capacitor Ce, which started to charge toward a value of −7 during the time increment $e_0$, thereafter discharges toward a value of +7 during the time increment $e_1$. As a result, the charges built up on the capacitor in the first 142.8 microsecond time interval $a_0 \ldots p_0$ are cancelled in the subsequent time interval $a_1 \ldots p_1$. It will be seen that all signals at the fundamental frequency are thus cancelled in the averager 124. Moreover all signals which are odd harmonics of the fundamental frequency as well as all signals not synchronous with the fundamental frequency will also be cancelled in the averager 124.

Random noises will present random voltages on each capacitor in successive half cycles. Since these values are random in nature they have an average of zero and after several successive half cycles they will cancel out. The only portions of the applied signal voltage that will be preserved after application in several successive half cycles are those portions which are synchronous with a one half cycle of the interrogation field. For those portions of the applied signal the successive values presented to each capacitor remain constant so that each capacitor charges, half cycle after half cycle, to the full value of the signal voltage presented to it. The number of successive half cycles required to charge each capacitor to the full value of the applied voltage will depend on the time constant formed by the product of the value of capacitance of the capacitor and the value of resistance of the resistor 128.

Curve B in FIG. 8 represents, stylistically, the case where a target becomes saturated by magnetic field which alternates according to curve A, and where the target is isolated from all other magnetic effects, such as the earth's magnetic field. For purposes of illustration it is assumed that the object will become magnetically saturated wherever the value of the interrogation field corresponds to +3 or −3; and the object will produce a pulse during the interval when it is not saturated. The sense of the pulse will correspond to the direction of change in the magnetic interrogation field. As can be seen, the object will produce a positive pulse during the intervals $g_0 \ldots j_0$, and a negative pulse during the interval $g_1 \ldots j_1$, i.e. one half cycle apart. The voltages representative of these pulses will therefore cancel in the capacitors Cg . . . Cj. This occurs for all signals which are symmetrical in time relative to the interrogation frequency.

The situation is different where the magnetic saturation of an object is affected not only by the magnetic interrogation field but also by the earth's magnetic field. In the example of FIG. 8 the earth's magnetic field, which is constant, is represented by a straight dashed line at a value −2 superimposed on curve A. In this case, an object which had become saturated at a value of +3 and −3 of the interrogation field when no other field was present, will now become saturated at values +5 and −1 of the interrogation field when the earth's magnetic field is present. The pulses corresponding to the object's going into and out of saturation are shown in curve C. As can be seen, the object will now produce a positive pulse during the intervals $h_0 \ldots k_0$ and a negative pulse during the intervals $f_1 \ldots j_1$. Since these pulses are not exactly a half cycle apart they will be only partially cancelled. Thus, purely symmetric pulses are cancelled in the averager 124; but, as the pulses become more asymmetric, they pass through the averager to an extent corresponding to the amount of the asymmetry.

It will be appreciated that the asymmetry produced by the earth's magnetic field enables a magnetically saturable object to be detected whereas it could not have been detected in the absence of such field. In addition, the effect of the earth's magnetic field on the symmetry of the signals will be much greater in the case of objects which saturate at low magnetic fields, i.e. targets 30, than for objects which saturate only at high magnetic fields, i.e. ordinary metal objects. In the case of targets 30 which saturate at low magnetic fields, the resulting pulses are narrower and, when shifted asymmetrically, become more distinctly separated so that little or no portion of the pulses are cancelled in the averager 124, whereas in the case of objects which saturate only at high magnetic fields, the resulting asymmetric pulses have greater overlap, so that much greater portions of the pulses are cancelled in the averager.

The size of the resistor 128 in the signal line 126 and the size of the capacitors Ca . . . Cp define the time constant of the individual signal storage or sampling elements in the averager. The time constant should be short enough to permit the capacitor to acquire the charge corresponding to a target signal for the minimum period of time the target is assumed to be within the interrogation zone. On the other hand, the time constant should not be so short to permit the capacitor to acquire a charge in one half cycle, but only an average charge in several half cycles so that the cancellation process for separating symmetrical and asynchronous signals can take full effect. The number of capacitors and associated switches used in the averager establishes the maximum frequency which the averager will pass. In the preferred embodiment forty eight capacitors and associated switches are used so that, as stated above, each capacitor is connected to the signal line for an interval of 47.6 microseconds. Thus the sampling rate is 21 KHZ. This enables the averager to process signals up to 10.5 KHZ. Signals above 10.5 KHZ which are applied to the averager will give anomolous results and accordingly the low pass filter 102 limits the frequencies applied to the averager to less than 10.5 KHZ. Of course higher frequency components can be processed by using a greater number of capacitors and associated switches so that the sampling duration of each capacitor is reduced. However, for a fundamental or transmitter frequency of 218.75 KHZ it has been found that the most characteristic frequency harmonics of reasonable amplitude produced by the targets 30 are less than 10.5 KHZ.

Reverting now to FIGS. 6B and 6C it is seen that the output of the signal averager 124, which appears at its output terminal 124*c*, is supplied via a second channel line 130 and connector J2 (FIG. 6B) and J1 (FIG. 6C) to a low pass filter 132 (FIG. 6C) and a high pass filter 134 which remove any of the low frequency components which may have been introduced by the scanning signals applied to the scanning input terminals 124*b* of the averager 124 and any high frequency components which may have been introduced by the capacitor switches inside the averager. The output of the filter 134 is passed through a full wave rectifier 136 where it is rectified. The rectified signal is then applied to a first high field exclusion gate 138. The high field exclusion gate 138 receives gating signals from a decoder 140 which in turn receives signals from the terminal 68*b* of the binary divider 68 (FIG. 6A).

The binary divider 68 is arranged so that the terminal 68*b* is energized during all but those portions of the interrogation field cycle when the interrogation field is near its maximum positive and negative intensity. When the terminal 68*b* is energized, the high field exclusion gate 138 is open and when the terminal 68*b* is not energized the gate is closed. As a result, signals from the rectifier 136 do not pass through the gate when the interrogation field in the interrogation zone 24 is near its maximum intensity. The purpose for this is to avoid the production of signals from other metal objects which saturate only at high magnetic fields. In general all true targets (which saturate at low fields) will have been saturated at the time the gate 138 is closed, except for targets which may be located or oriented in poor magnetic coupling relationship to the interrogation coil. However if an ordinary metal object saturates when the interrogation field is at its maximum intensity, the resulting signal from the object is so much greater than any target signal that it would overwhelm and mask the target signal.

The signals which pass through the gate 138 are applied to a low pass filter 141 which integrates them and converts them to direct current. The signals are then passed through an adder amplifier 142. The output of the amplifier 142 is then applied to a first input terminal 146*b* of a comparator 146.

The signal appearing on the first channel line 114 (FIG. 6B), which was taken from the low pass filter 112 (immediately preceeding the signal compressor 118 and the signal averager 124), is connected via the connectors J2 (FIG. 6B) and J1 (FIG. 6C) to a full wave rectifier 148 where it is rectified. This rectified signal is then applied to a second high field exclusion gate 150. This gate receives gating signals from the gate terminal 68*c* of the binary divider 68 (FIG. 6A).

The binary divider 68 is also arranged so that the terminal 68*c* is energized during all but those portions of the interrogation field cycle when the interrogation field is near its maximum intensity. When the terminal 68*c* is energized the gate 150 is open and when the terminal 68*c* is not energized the gate is closed. As a result, signals from the rectifier 148 do not pass through the gate 150 when the interrogation field in the interrogation zone 24 is near its maximum intensity. The purpose for this will be explained hereinafter.

The signals which pass through the gate 150 are applied to a low pass filter 152 which integrates the signals and converts them to direct current. The signals are then amplified in an amplifier 154 and are applied to a second input terminal 146*a* of the comparator 146. When the magnitude of the signals appearing at the input terminal 146*b* of the comparator 146 is sufficiently large in relation to the magnitude of the signals appearing at the input terminal 146*a* of the comparator, the comparator produces an alarm signal at an output terminal 146*c*. This terminal is connected to an input terminal 156*a* of a timer 156 which produces an alarm actuation signal at an output terminal 156*c*. This terminal is connected to energize the alarm light 28 (FIG. 1).

The operation of the system shown in FIGS. 6A, 6B and 6*c* will now be described. The oscillator 62 shown in FIG. 6A produces a continuous high frequency signal, e.g. at 168 KHZ which is divided down in the divider 66, the binary divider 68 and the flip-flop 71 to a frequency of 218.75 HZ. This signal, which is in the form of a square wave, is passed through the long time constant demodulator 76, the all pass filter 88, the low pass filter 92 and the high pass filter 94 to the power amplifier 96 where the signal is amplified and applied to the interrogation coils 42 and 44. These coils, together with the transmitter antenna capacitor 56, produce an essentially pure sine wave alternating current flow which in turn generates an essentially pure sine wave alternating magnetic field at 218.75 HZ in the interrogation zone 24. The frequency of 218.75 HZ was chosen because it is not closely related, hamonically, to sources of potentially interferring signals, such as may be generated from nearly electrical equipment. It is of course, possible to use other frequencies; and in such case the timing of the signals from the binary divider 68 will be correspondingly changed.

As described above, the alternating magnetic interrogation field generated in the interrogation zone 24 may be continuous or, where the mat switch 32 is used, the field may be generated only during an interval of a few seconds after a customer or a shopping cart has pressed down on the mat switch 32.

The transmitter antenna coils 42 and 44 on the opposite sides of the interrogation zone 24 are shaped and arranged such that the alternating magnetic interrogation field will drive a target 30 in the zone alternately into and out of magnetic saturation for nearly every position and orientation of the target within the zone. The magnetic interrogation field is much stronger near the panels 20 and 22 than it is near the center of the interrogation zone.

The magnetic interrogation field in the interrogation zone has minimal effect upon the receiver loops 50 and 52 because the interrogation field is aplied equally to each loop and the loops are connected in bucking relationship.

When a target 30 is carried into the interrogation zone 24 it is, at nearly every position along its path through the zone, closer to one of the receiver loops 50 and 52 than to the other. Thus the magnetic field disturbances produced by the target are stronger at one loop than the other and a net electrical signal is produced at the receiver antenna connections.

When a target 30 passes through the interrogation zone 24, it is driven into and out of magnetic saturation in a repetitive manner by the magnetic interrogation field from the coils 42 and 44. Each time the target 30 is driven out of and back into saturation it produces a pulse. These pulses contain only harmonics of the magnetic interrogation field frequency and the relative amplitudes of these harmonics have a characteristic arrangement. That is, the higher harmonics do not diminish in amplitude as sharply as the higher harmonics produced when an ordinary piece of metal is driven intomagnetic saturation.

The magnetic pulses produced by the targets 30 have another distinguishing characteristic which is caused by the fact that the targets are also subjected to the effects of the earth's magnetic field. The earth's magnetic field is continuous and it serves as a bias to the alternating interrogation magnetic field. The earth's magnetic field, moreover, is constant throughout the interrogation zone 24, while it is not possible, practically, to generate an interrogation field whose intensity is constant throughout the zone. This enables the earth's magnetic field to be utilized as a reference in order to establish the permeability/saturation induction level of the material producing the received pulses. This in turn causes the signals produced by the target 30 to be asymmetric. The earth's magnetic field produces a similar effect on the signals produced by ordinary pieces of metal which become saturated in the interrogation zone, but the effect is proportionally much less than in the case of the targets 30 because the targets saturate at a very low magnetic field whereas ordinary metallic objects require a much higher magentic field for saturation. Consequently, when the target 30 becomes saturated the ratio between the magnetic induction caused by the earth's magnetic field and the magnetic induction caused by the interrogating magnetic field in the target 30 is much higher than it is when an ordinary piece of metal becomes saturated. This phenmenon is used in the present invention to distinguish the targets 30 from ordinary metallic objects. Specifically, the ratio between the induction caused by the earth's magnetic field and the induction caused by its interrogation field is obtained by comparing the asymmetrical portion of the signal to the total signal. A signal which is perfectly symmetrical relative to the period of the interrogation field will have, at each instant in the second half period, an amplitude which is equal in magnitude and opposite in direction to the amplitude at each corresponding instant in the first half cycle or half period. The degree to which the amplitudes in the second half period are not equal in magnitude and opposite in direction to their counterparts in the first half period constitutes the degree of asymmetry of the signal.

The magnetic fields produced by the targets 30 as well as all other magnetic signals present in the interrogation zone 24 interact with the receiver loops 50 and 52 and produce corresponding electrical currents in those loops. As stated, those fields which interact equally with both loops 50 and 52 are cancelled because the loops are connected in bucking relationship. However, since a target 30 in the interrogation zone 24 is nearly always closer to one loop than the other it will produce an unbalanced effect and a net signal which is applied to the corrective filter 100, the notch filter 102, the low noise amplifier 104, the differential amplifier 106, the high pass filter 108, the amplifier 110 and the low pass filter 112. As previously explained these filters and amplifiers remove from the incoming signals those frequency components which are not useful in ascertaining the presence of a true target 30 and which could be detrimental to ascertaining the target during subsequent signal processing. Thus the filters remove the fundamental or interrogation frequency as well as higher frequencies which could cause anomalous results in further signal processing.

The signal from the low pass filter 112 is directed along the first and second channel lines 114 and 116. The signal in the second channel line 116 passes through the signal compressor 118 and the averager 124. Then, as shown in FIG. 6C, that signal passes along the second channel line 130 through the low and high pass filters 132 and 134, the rectifier 136, the gate 138, the low pass filter 141 and the adder amplifier 144 to apply a votage corresponding to the asymmetry of the detected magnetic field to the terminal **146*b* of the comparator 146. The signal in the first channel line 114 bypasses the signal compressor 118 and the averager 124 and instead is applied directly to the full wave rectifier 148 (FIG. 6C), the gate 150, the low pass filter 152 and the amplifier 154 to apply a voltage corresponding to the total amplitude of the detected magnetic field to the terminal 146*a* of the comparator 146**.

It will be appreciated that the comparator 146 compares signals representative of the asymmetry of the detected magnetic field with signals representative of the total magnitude of the detected magnetic field. If the amplitude of the asymmetry signal is sufficiently high relative to the amplitude of the total signal, the comparator 146 will produce an alarm output at its terminal **146*c* which is applied via the timer 156** to the alarm.

As indicated above, a true target 30 will saturate at a low magnetic field and the ratio of the earth's magnetic field to this saturating field is quite high. As a result the asymmetry signal produced by a target (applied to comparator terminal **146*a*) is high relative to the total signal produced by the target (applied to the comparator terminal 146*b*). On the other hand, a piece of metal which may saturate in the interrogation zone 24 requires a much higher magnetic field than a target to be driven into saturation; and the ratio of the earth's magnetic field to this saturating field is quite low. As a result, the asymmetry signal caused by the piece of metal is low relative to the total signal; and when these signals are compared in the comparator 146** no alarm signal will be produced.

The averager 124, as explained above, operates to remove from the incoming signal those components which are not synchronous with or harmonically related to the interrogation signal. In addition, as explained above, the averager, because it is scanned at twice the interrogation signal frequency, eliminates all symmetrical components of the received signal. Thus, the only signals which pass through the averager are those asymmetric components of the received signal which are synchronous with the interrogation frequency. The signal compressor 118, reduces the gain of the signal channel 116 in proportion to the amplitude of the received signal. As a result, the output from the averager 124 corresponds quite closely with the degree of asymmetry of the received signal, irrespective of that signal's total amplitude. This then permits the comparator 146 to compare the total amplitude of the received signal (which passes through the signal channel 114) with another signal which is truly representative of the asymmetry of the received signal.

It can be seen from the foregoing that this arrangement permits the accurate detection and separation of signals from true targets 30 even though those signals may be substantially smaller in amplitude than the signals from ordinary pieces of metal which are driven into magnetic saturation in the interrogation zone 24. In fact, the true target signals will be distinguished from ordinary metal signals even in cases where the asymmetrical portion of signals from ordinary metal objects is significantly larger in amplitude or energy content than the asymmetrical portion of the true target signals. As to this last mentioned feature, this is achieved because the system does not merely produce an alarm signal based on the magnitude of the asymmetric portion of the received signal. Instead, it compares amplitude of the asymmetric portion to the amplitude of the total signal; and when the ratio of these amplitudes exceeds a predetermined threshold it produces an alarm signal. This ratio is established by setting the gain of the adder amplifier 142. This threshold is established by injecting direct current into the amplifier 142, the amount so injected being adjusted by a threshold adjustment potentiometer 144. Thus, when the amplitude of the accumulated or integrated asymmetrical portion of the received signal times the gain of the adder amplifier 144 exceeds the amplitude of the accumulated or integrated full received signal times the gain of the amplifier 154, by an amount which constitutes the threshold, an alarm output is generated by the comparator 146.

As pointed out above, the gate 138 excludes from consideration any asymmetric signals produced during the intervals when the magnetic interrogation field is most intense. Similarly, the gate 150 is timed (according to signals from the decoder 140 and the binary divider 68) to eliminate from comparison any signals present on the full signal channel line 114 when the magnetic interrogation field is at its highest intensity. The purpose for this is to avoid accumulation in the low pass filter 152 those signals from the first or full signal channel 114 which occur at the same time that asymmetric signals are being gated out from the second or asymmetric signal channel 116, 130. Although both gates 138 and 150 are closed while the magnetic field intensity in the interrogation zone 24 is at a maximum, separate gating signals are applied to those gates from the decoder 140. This is because the phase and width of the signals in the two channels is not the same due to delay produced in the filters 132, 134 and due to the fact that signals originating from the averager are sharper than the first signals on the line 114.

Figure 9:
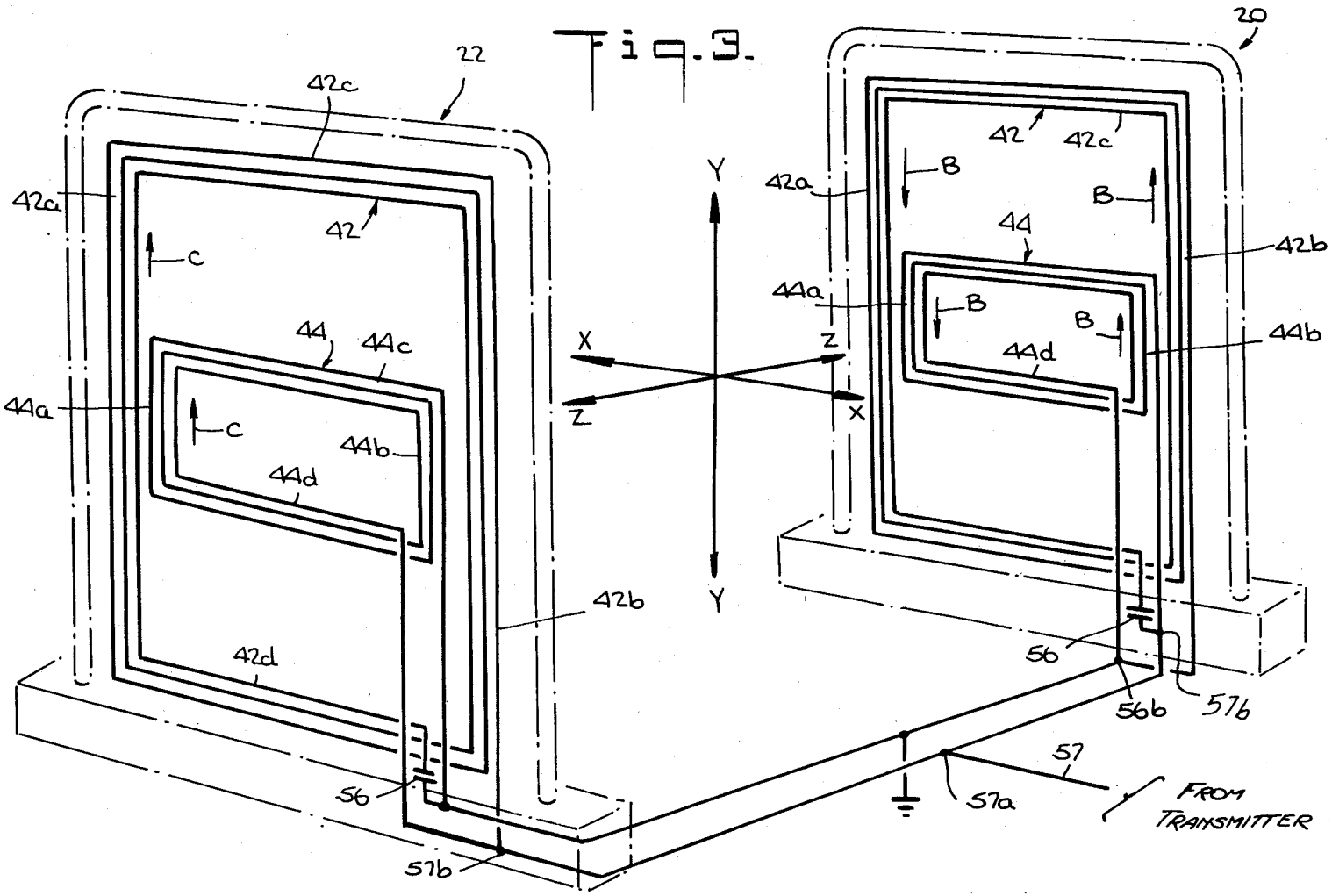
FIG. 9 is a diagram showing the arrangement of the components of FIG. 6 on a power input board, an alarm board and a main board.

FIG. 9 shows in block diagram form how the various components are arranged in the system of FIGS. 1–6. As shown in FIG. 9 there are provided a power input board 160, a main board and an alarm board 164. The power input board contains a connector 166 for connection to an external source of electrical power and a power supply circuit 168 which receives the external electrical power and supplies it via supply lines 170 to the alarm board 164. The power supply circuit also supplies power to the power amplifier 96 which is mounted on the power input board 160. The high pass filter 94, which comprises a capacitor 172 and a potentiometer 174, is also mounted on the power input board 160. The potentiometer is connected to the input **96*a* of the power amplifier 96. The input 94*a* of the high pass filter 94 is connected via a connecting line 176 to a terminal J3 on the main board 162**.

The main board 162, as shown, is connected to the receiver antenna loops 50 and 52. As can be seen, the main board 162 contains the oscillator 62 and crystal 64, the divider 66, the binary divider 68 and latches 70, the flip-flop and counter 71 and 72, the demodulator 76, the all pass filter 88 and the low pass filter 92. The output of these circuits is connected via the connector J3 and the connecting line 176 to the high pass filter 94 in the power input board 160. The receiver antenna loops 50 and 52 are connected in the main board 162 to the filters and amplifiers 100, 102, 104, 106, 108, 110 and 112. The main board 162 also contains the signal channel lines 114 and 116, the compressor 118 and the averager 124. The terminals **68*b* and 68*c* of the binary divider 68 and the output terminal 124*c* of the averager 124 are connected via the connector J2 to the connector J1 on the alarm board 164. Direct current voltages used to power the various components on the main board 162 are received at the connector J2 from corresponding terminals of the connector J1 on the alarm board 164**.

The alarm board 164 is provided with a rectifier and voltage control circuits 180 which convert alternating current signals received via the lines 170 from the power supply 168 in the power input board 160 to direct current voltages at appropriate levels for operating the various components of both the main board 162 and the alarm board 164.

The alarm board 164 also includes the decoder 140 and the gates 138 and 150. The decoder 140 receives signals from the binary divider 68 via the connectors J2 and J1. The alarm board 164 also includes the full signal channel line 114 which is connected via the connectors J1 and J2 to the filter 112 in the main board 162. The alarm board also includes the rectifier 148 connected between the line 114 and the gate 150 and the filter 152 and amplifier 154. The asymmetrical signal line 130 from the averager 124 on the main board 162 is connected via the connectors J2 and J1 to the filter 132 in the alarm board 164 and from there to the filter 134 and the rectifier 136. The alarm board also contains the filter 141 and the adder amplifier 142 and threshold adjustment 144 as well as the comparator 146 and the timer 156.

Figure 10:
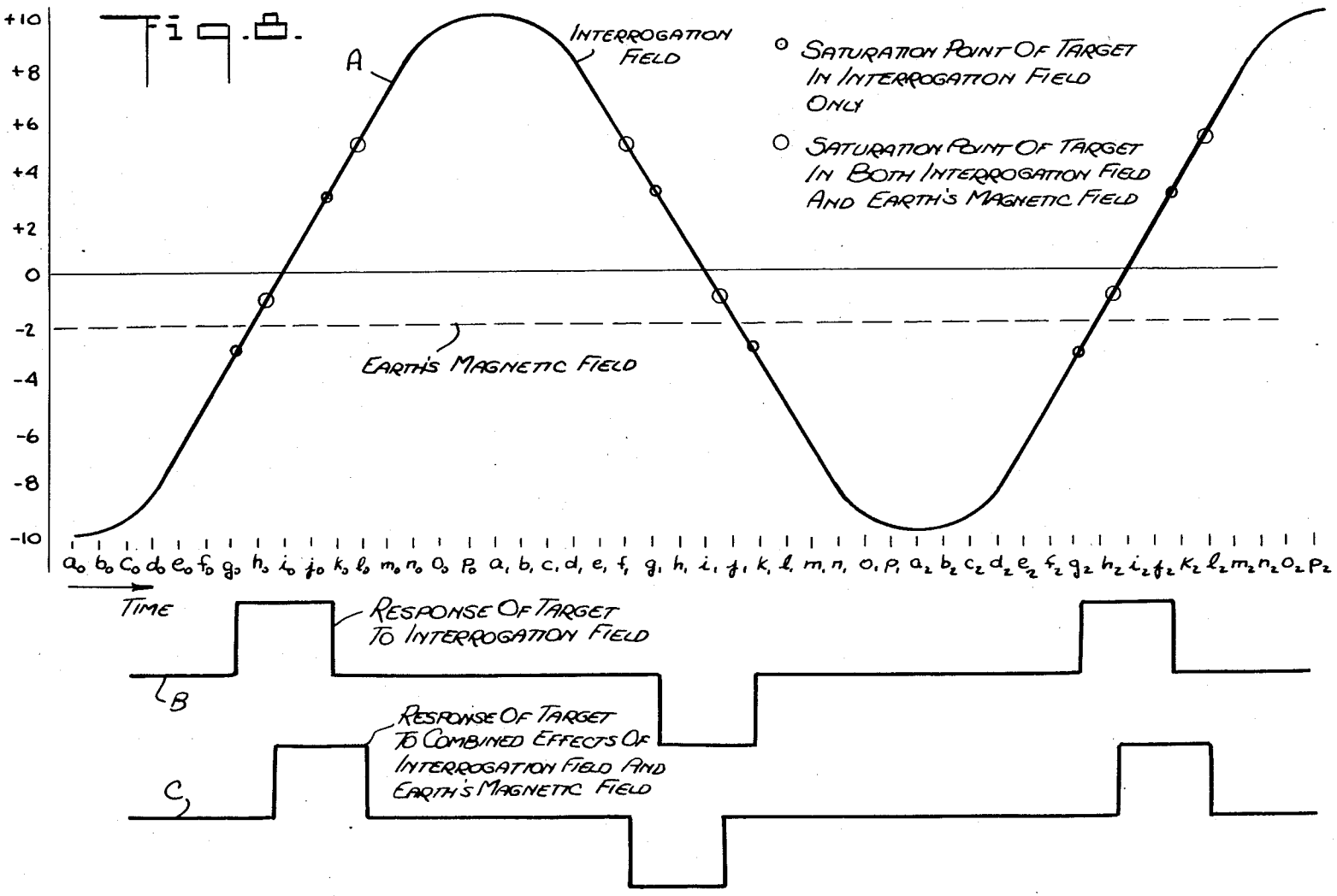
FIG. 10 is a schematic showing the circuits on the power input board.
Figure 9:
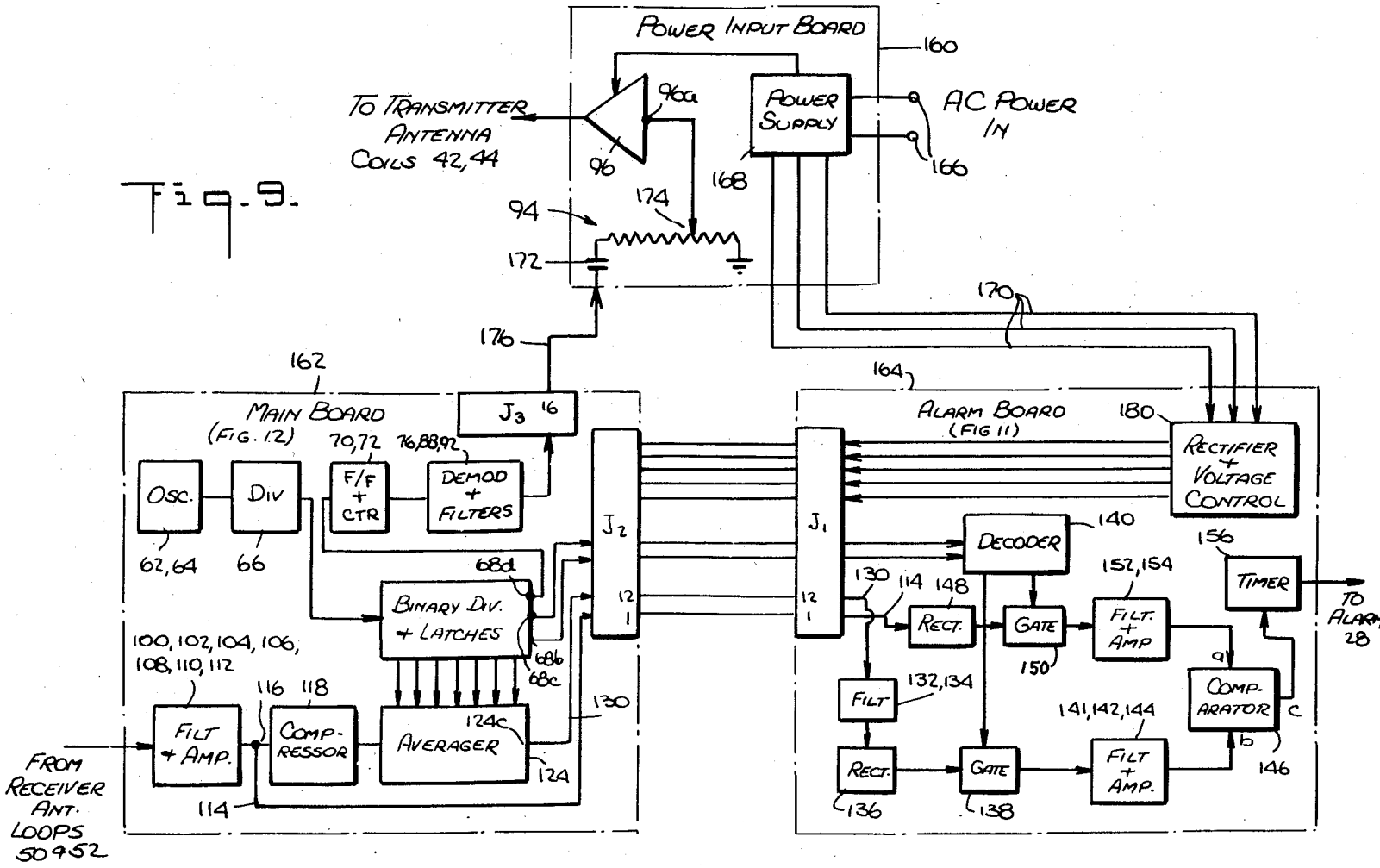
Figure 10:
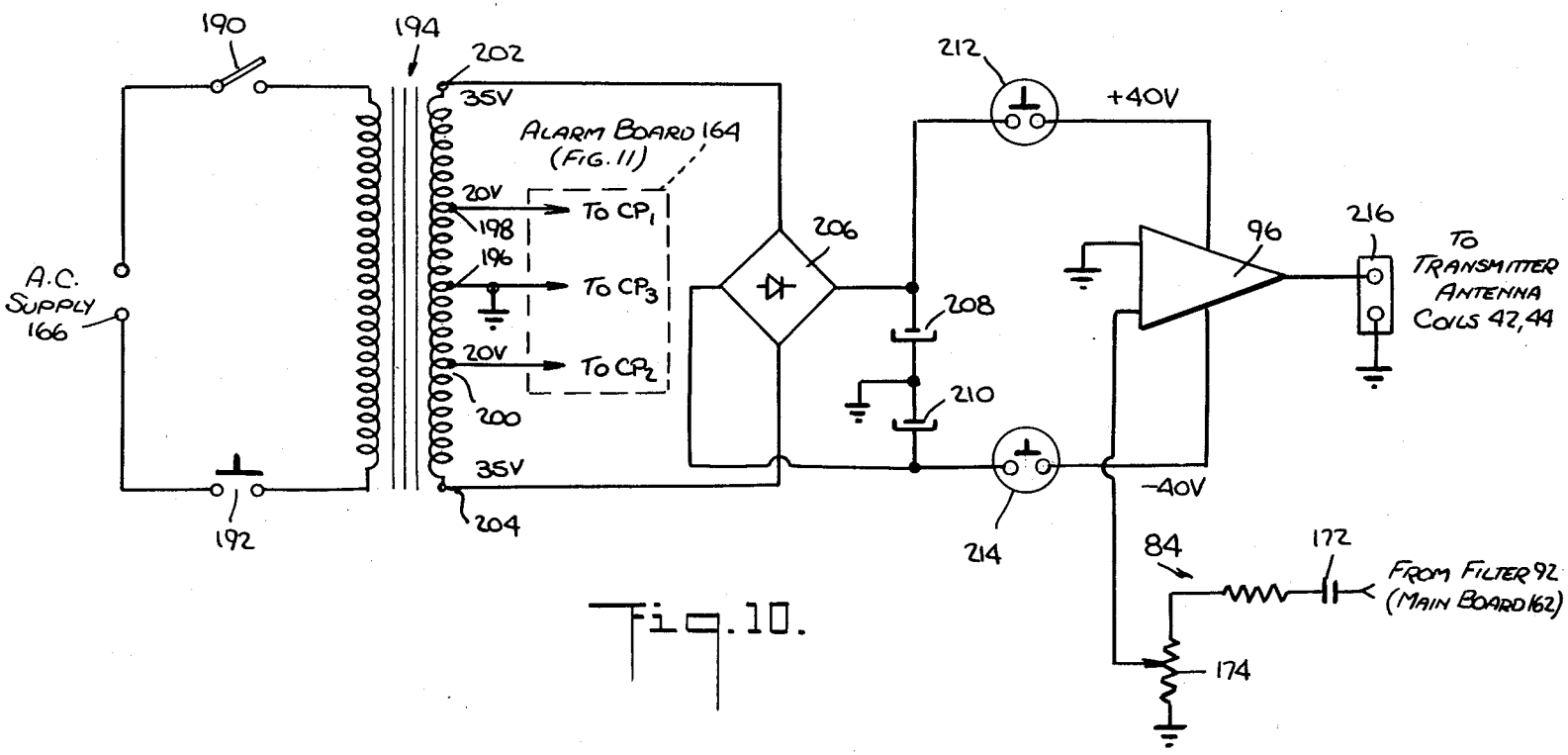

FIG. 10 shows in detail the circuits contained on the power input board 160.

As shown in FIG. 10 the alternating current input 166 is connected via a switch 190 and a circuit breaker 192 to the primary winding of a multiple tap transformer 194. The secondary of the transformer is arranged with a gounded center tap 196 and oppositely phased 20 volt taps 198 and 200 and oppositely phased 35 volt taps 202 and 204. The taps 198, 200 and 196 are connected respectively to terminals $CP_1$, $CP_2$ and $CP_3$ in the alarm board 164. The taps 202 and 204 are connected across a full wave rectifier 206 such as a Varo Model No. VK448 rectifier. The outputs of the rectifier 206, which are at plus 40 volts and minus 40 volts respectively, are each connected through a 2700 microfarad capacitor, 208 and 210, to ground. The rectifier outputs are also connected via circuit breakers 212 and 214 to the power amplifier 96. The power amplifier in this embodiment is a one hundred watt RCA monolithic power amplifier. The capacitor 172 in the filter 84, which supplies signals to be amplified in the amplifier 96, is chosen to be 0.022 microfarads and the potentiometer 174 includes two resistive elements of 10K ohms and 33K ohms respectively. As shown, the output of the amplifier 96 is connected to a terminal 216 from which leads extend to the transmitter antenna coils 42, 44.

Figure 11A:
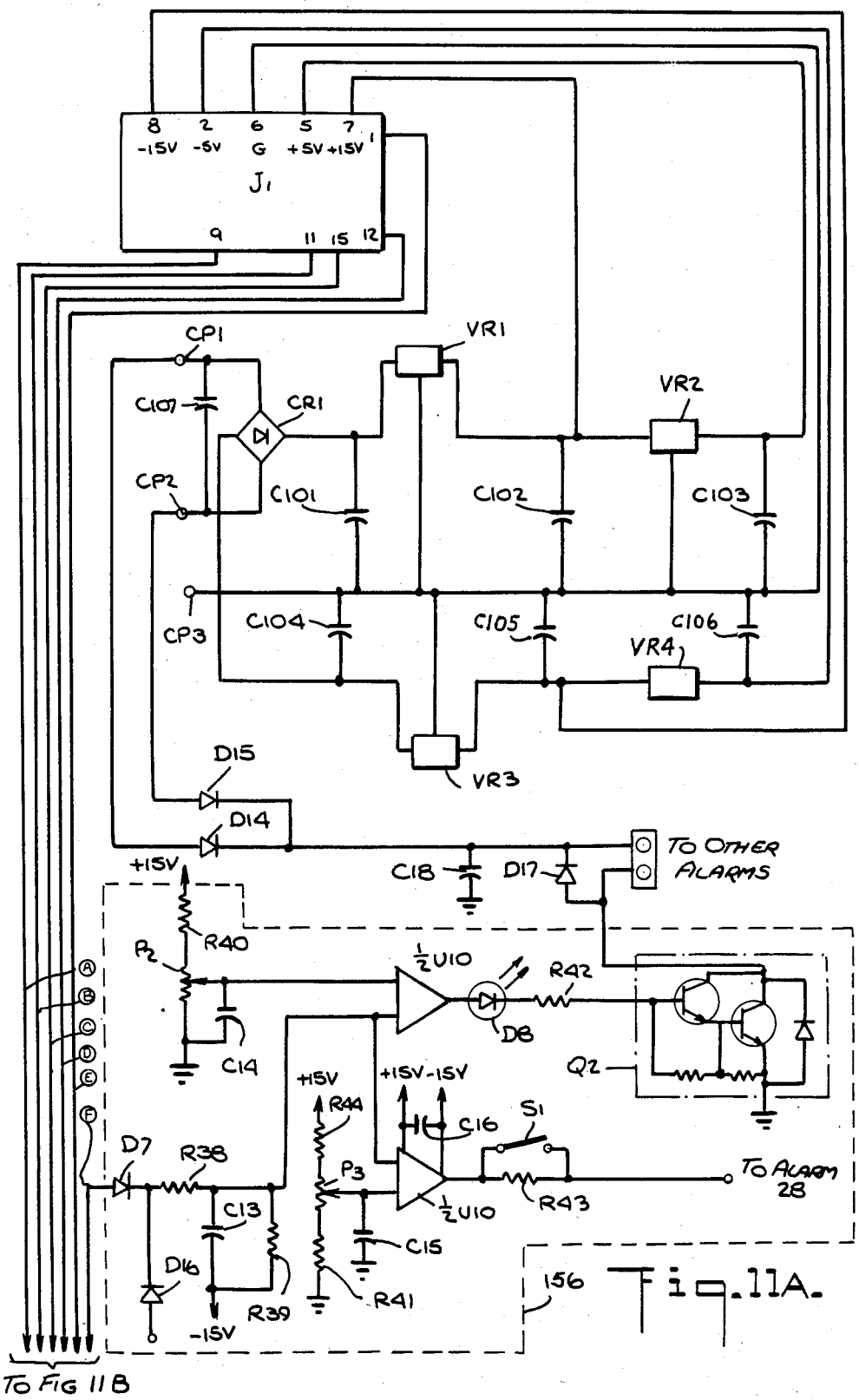
FIGS. 11A and 11B together form a schematic showing the circuits on the alarm board.
Figure 11B:
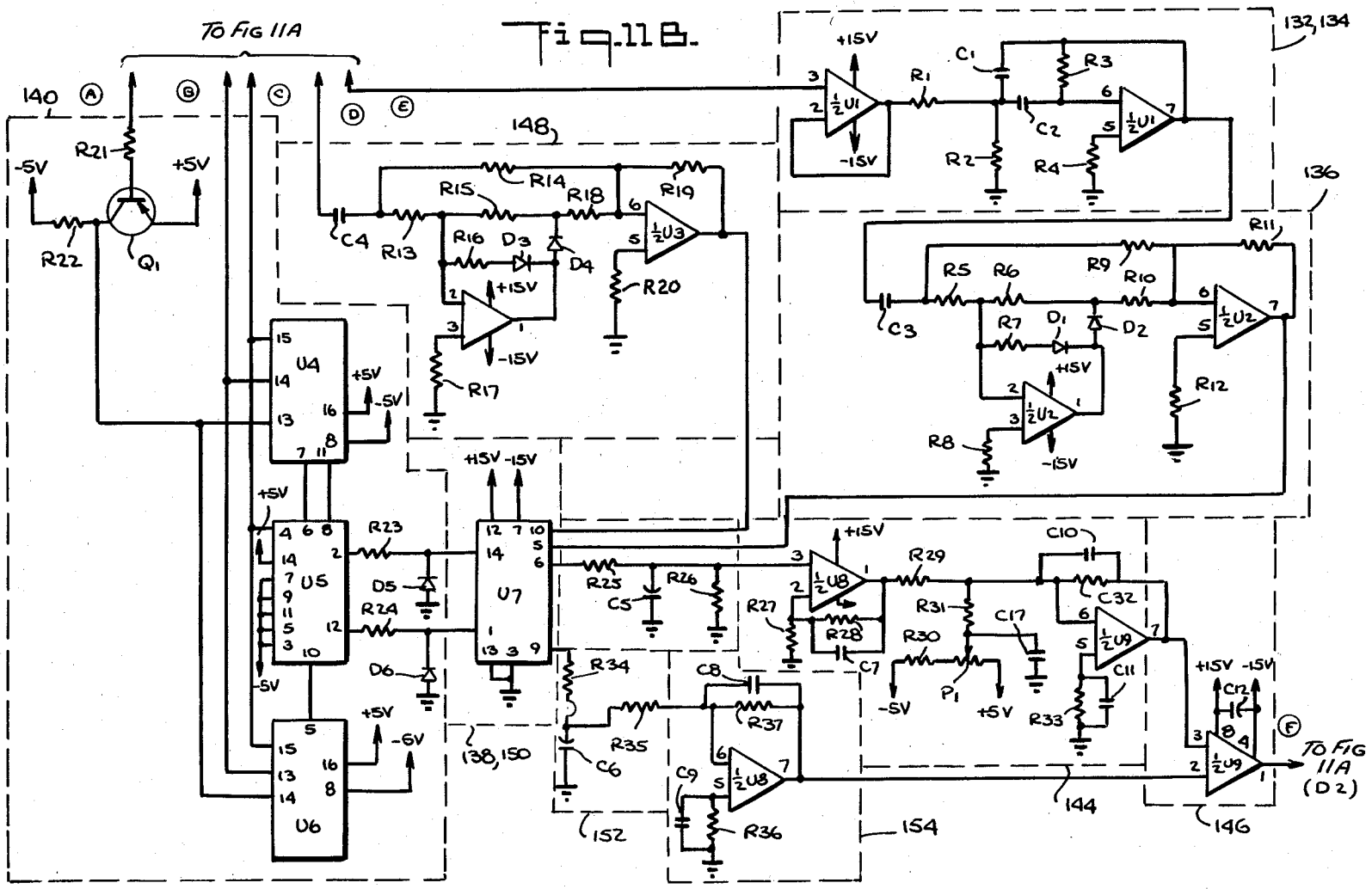
Figure 12A:
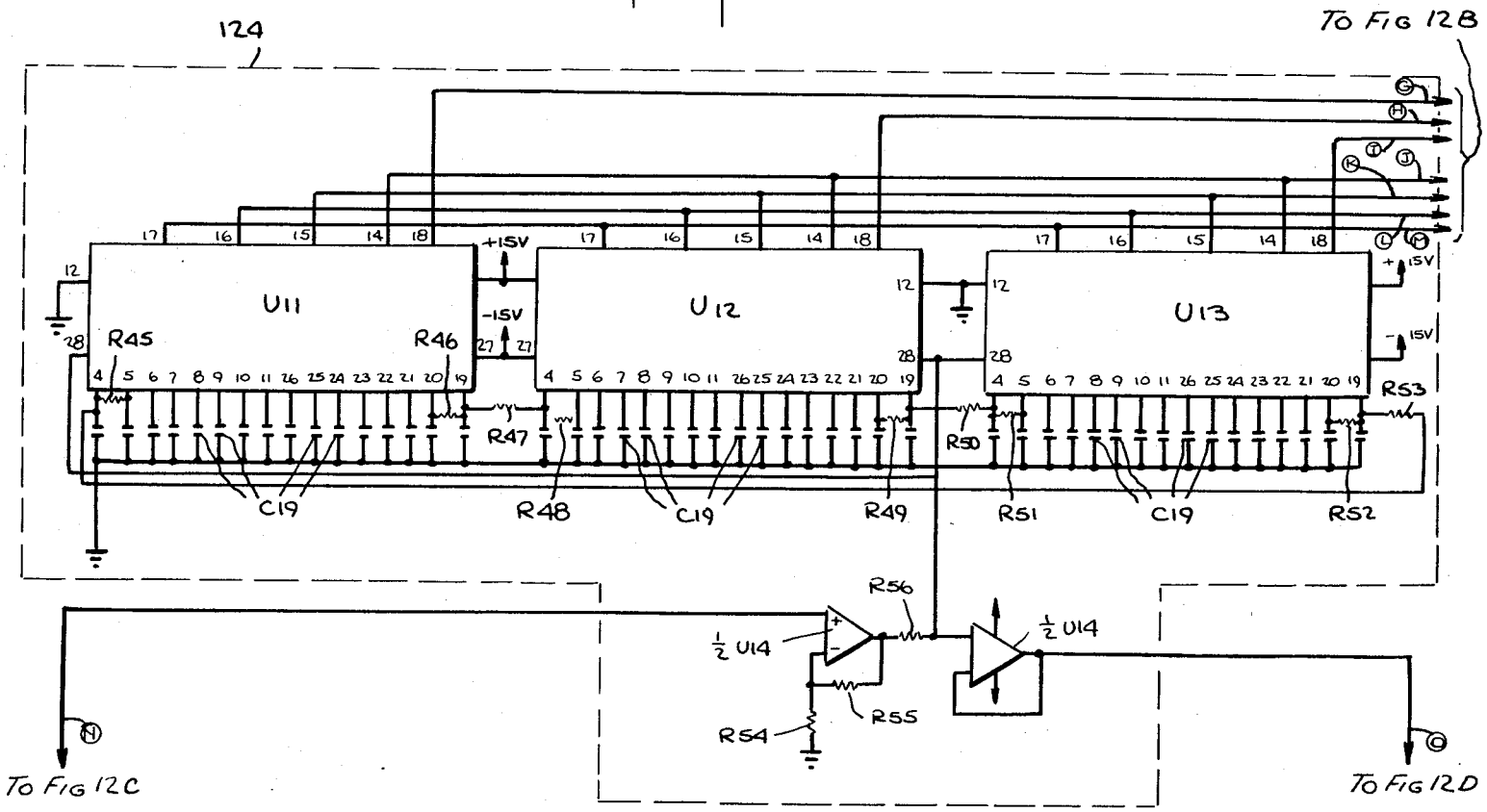
FIGS. 12A–12D together form a schematic showing the circuits on the main board.
Figure 12B:
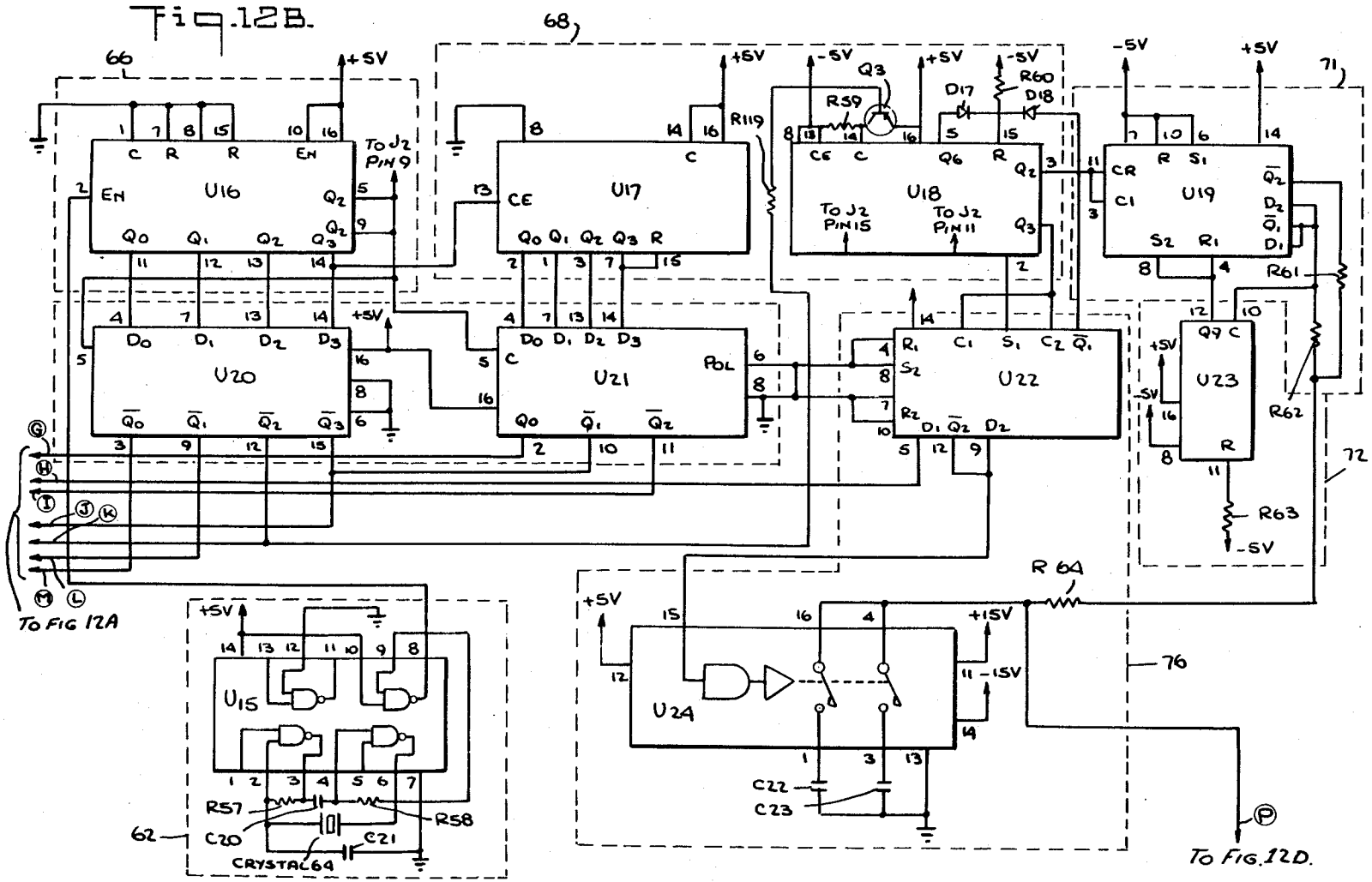
Figure 12C:
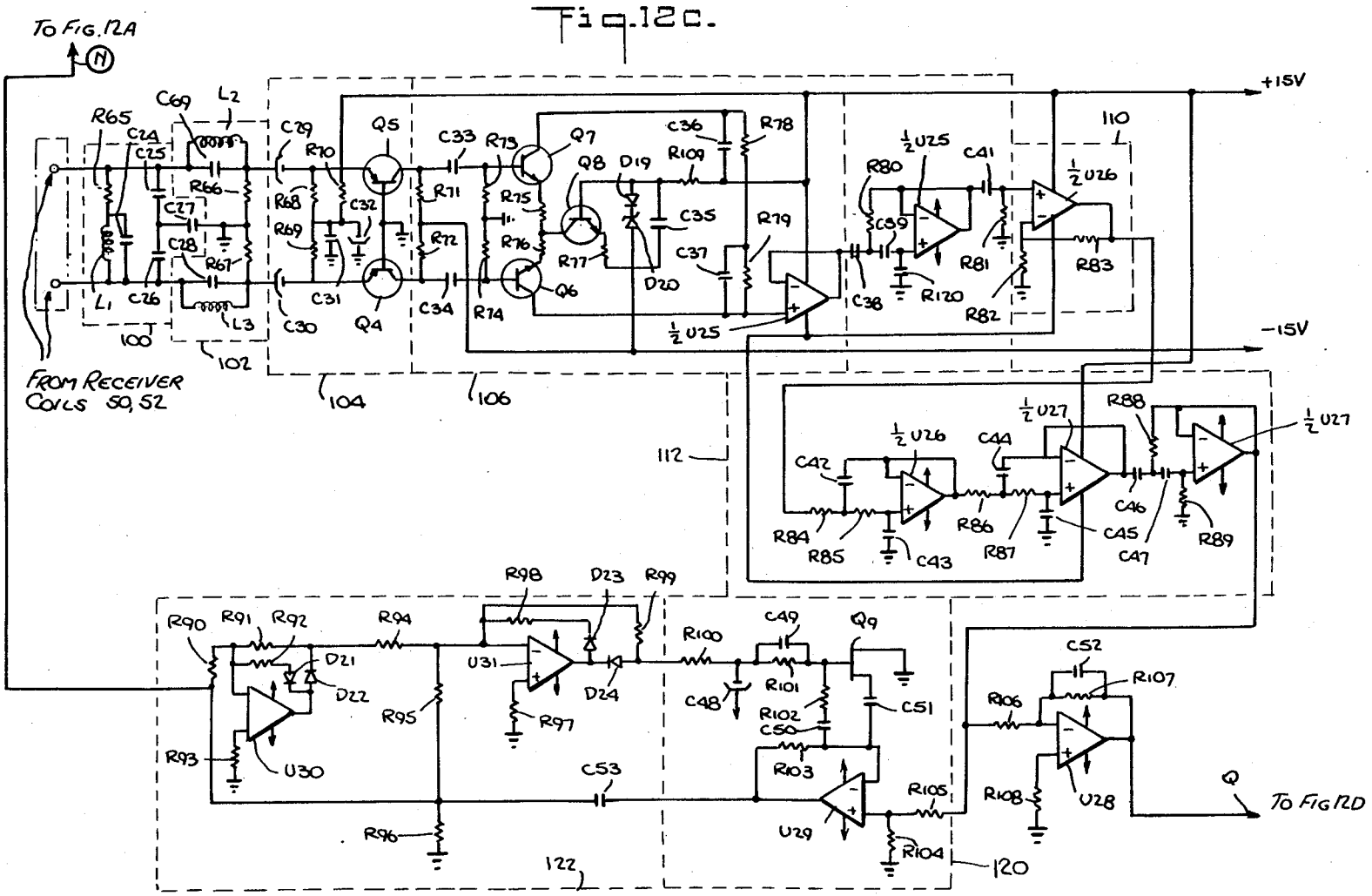
Figure 12D:
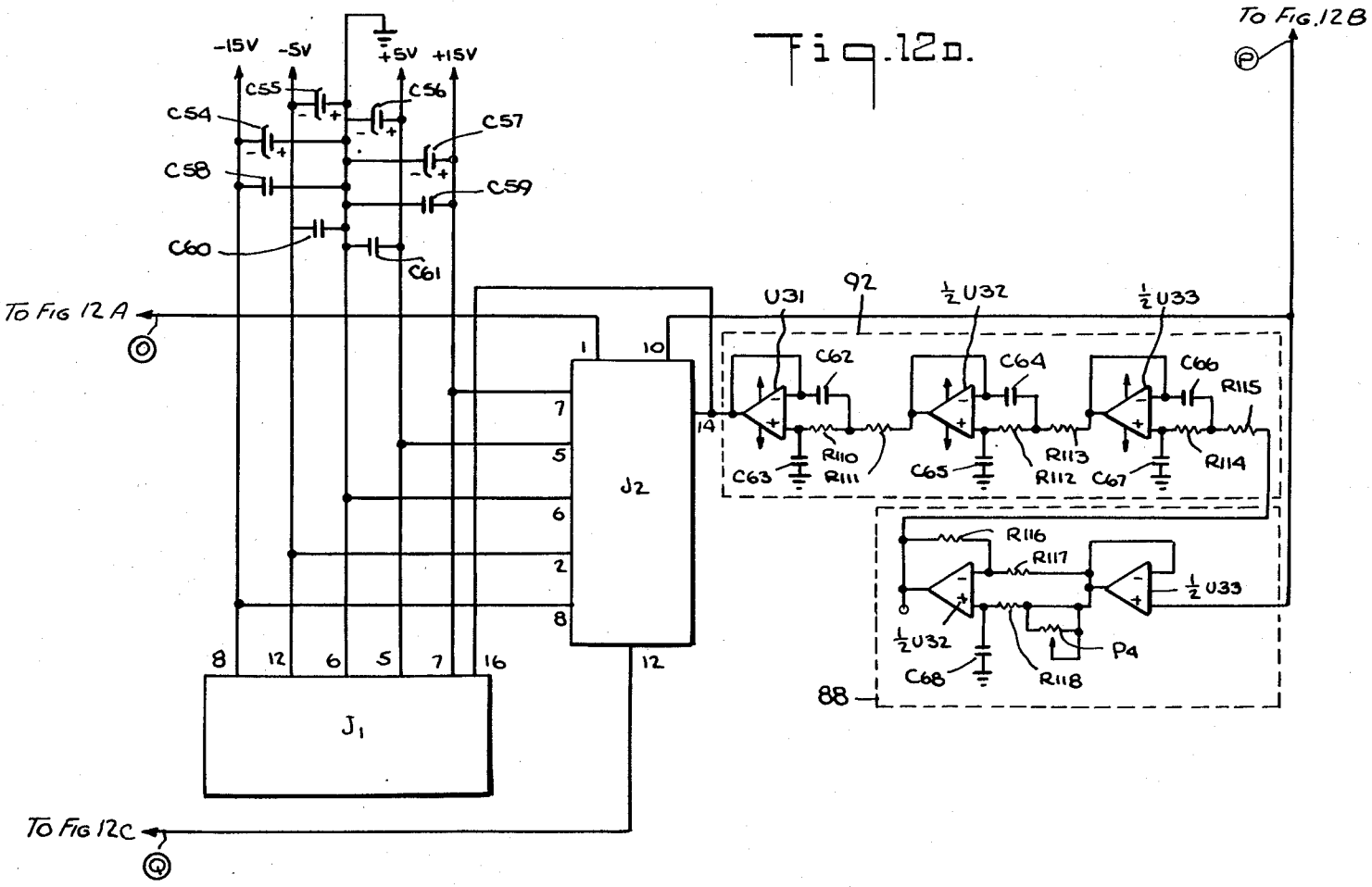

FIGS. 11A and 11B show the detailed circuits incorporated in the alarm board 164. As shown in FIG. 11A, there are provided terminals $CP_1$, $CP_2$ and $CP_3$ which, as indicated above, are connected to the transformer taps 198, 200 and 196 of the transformer 194 in the power input board 160 (FIG. 10). The various components from FIG. 6 are shown in dashed outline in FIG. 11.

The following tables show the values and model number and manufacturer (where appropriate) or industry standard designation of the various elements in FIG. 11.

| RESISTORS AND POTENTIOMETERS (K = 1000 ohms) | | |
|---|---|---|
| R1 - 8.2K | R11 - 56K | R21 - 20K |
| R2 - 430 ohms | R12 - 8.2K | R22 - 10K |
| R3 - 33K | R13 - 10K | R23 - 10K |
| R4 - 33K | R14 - 20K | R24 - 10K |
| R5 - 10K | R15 - 10K | R25 - 20K |
| R6 - 10K | R16 - 10K | R26 - 82K |
| R7 - 10K | R17 - 8.2K | R27 - 4.7K |
| R8 - 8.2K | R18 - 10K | R28 - 15K |
| R9 - 20K | R19 - 47K | R29 - 10K |
| R10 - 10K | R20 - 8.2K | R30 - 9.1K |
| R31 - 51K | R41 - 68K | |
| R32 - 10K | R42 - 1.1K | |
| R33 - 10K | R43 - 10K | |
| R34 - 20K | R44 - 18K | |
| R35 - 120K | | |
| R36 - 100K | P1 - 10K | |
| R37 - 240K | P2 - 250K | |
| R38 - 3K | P3 - 250K | |
| R39 - 2000K | | |
| R40 - 18K | | |

| CAPACITORS (UF = microfarads) | | |
|---|---|---|
| C1 - 0.01 farads | C11 - 0.1 UF | C104 - 470 UF |
| C2 - 0.1 UF | C12 - 2.2 UF | C105 - 2.2 UF |
| C3 - 0.1 UF | C13 - 2.2 UF | C106 - 2.2 UF |
| C4 - 0.1 UF | C14 - 0.1 UF | C107 - 0.1 UF |
| C5 - 1 UF | C15 - 0.1 UF | |
| C6 - 1 UF | C16 - 2.2 UF | |
| C7 - 0.1 UF | C17 - 470 UF | |
| C8 - 0.1 UF | C101 - 470 UF | |
| C9 - 0.1 UF | C102 - 0.1 UF | |
| C10 - 0.1 UF | C103 - 0.1 UF | |

INTEGRATED CIRCUITS

U1, U2, U3, U8, U9 and U10 are all operational amplifiers manufactured by Texas Instruments and identified as TL-082.

U4—Motorola No. 14022

U5—Motorola No. 14013

U6—Motorola No. 14022

U7—Siliconics No. DG200

The pin connections for these circuits are identified in the drawings. Equivalent circuits are made by other manufacturers and can be identified in standard reference manuals.

TRANSISTORS

Q1—2N3799 NPN

Q2—Motorola No. TIP102 (Darlington power transistor)

DIODES (Numbers are standard for the industry)

D1 through D7—IN914

D8—Standard light emitting diodie

D14—IN2070

D15—IN2070

D16—IN914

VOLTAGE REGULATORS (Numbers are standard for the industry)

VR1—7815

VR2—7805

VR3—7915

VR4—7905

RECTIFIER

CR1—Motorola No. MDA920 A-Z

FIGS. 12A through 12D show the detailed circuits incorporated in the main board 162.

The following tables show the valuse and model number and manufacturer (where appropriate) or industry standard designation of the various elements in FIG. 12.

| RESISTORS AND POTENTIOMETERS (K = 1000 ohms) | | |
|---|---|---|
| R45 - 2400K | R55 - 47K | R65 - 39 ohms |
| R46 - 2400K | R56 - 47K | R66 - 10K |
| R47 - 2000K | R57 - 10K | R67 - 10K |
| R48 - 2400K | R58 - 10K | R68 - 10K |
| R49 - 2400K | R59 - 10K | R69 - 10K |
| R50 - 2000K | R60 - 20K | R70 - 7.5K |
| R51 - 2400K | R61 - 10K | R71 - 13K |
| R52 - 2400K | R62 - 10K | R72 - 13K |
| R53 - 2000K | R63 - 10K | R73 - 150K |
| R54 - 1.5K | R64 - 330K | R74 - 150K |
| R75 - 13K | R85 - 9.1K | R95 - 20K |
| R76 - 13K | R86 - 3K | R96 - 1.5K |
| R77 - 10K | R87 - 22K | R97 - 10K |
| R78 - 15K | R88 - 68K | R98 - 240K |
| R79 - 15K | R89 - 10K | R99 - 450K |
| R80 - 2K | R90 - 10K | R100 - 1K |
| R81 - 12K | R91 - 10K | R101 - 1000K |
| R82 - 6.8K | R92 - 10K | R102 - 1000K |
| R83 - 4.7K | R93 - 4.7K | R103 - 10K |
| R84 - 2.4K | R94 - 10K | R104 - 2K |
| R105 - 68K | R115 - 33K | |
| R106 - 10K | R116 - 10K | |
| R107 - 430K | R117 - 10K | |
| R108 - 100K | R118 - 7.5K | |
| R109 - 4.7K | R119 - 22K | |
| R110 - 8.2K | R120 - 20K | |
| R111 - 8.2K | P4 - 10K | |
| R112 - 22K | | |
| R113 - 22K | | |
| R114 - 33K | | |

CAPACITORS
(all values are given in farads except that "PF" corresponds picofarads and "UF" corresponds to microfarads)

| | | |
|---|---|---|
| C19 - 0.1 | C29 - 220 UF | C39 - 0.0068 |
| C20 - 0.01 | C30 - 220 UF | |
| C21 - 100 PF | C31 - 0.1 | C41 - 0.01 |
| C22 - 0.47 | C32 - 2.2 | C42 - 0.0068 |
| C23 - 0.47 | C33 - 0.1 | C43 - 0.001 |
| C24 - 0.047 | C34 - 0.1 | C44 - 0.0033 |
| C25 - 0.22 | C35 - 0.1 | C45 - 0.001 |
| C26 - 0.22 | C36 - 0.001 | C46 - 0.022 |
| C27 - 0.22 | C37 - 0.001 | C47 - 0.01 |
| C28 - 5 UF | C38 - 0.068 | C48 - 1 UF |
| C49 - 10 PF | C59 - 0.1 | |
| C50 - 0.01 | C60 - 0.1 | |
| C51 - 5 UF | C61 - 0.1 | |
| C52 - 39 PF | C62 - 0.33 | |
| C53 - 0.33 | C63 - 0.022 | |
| C54 - 2.2 UF | C64 - 0.047 | |
| C55 - 2.2 UF | C65 - 0.022 | |
| C56 - 2.2 UF | C66 - 0.022 | |
| C57 - 2.2 UF | C67 - 0.015 | |
| C58 - 0.1 | C68 - 0.1 UF | |

COILS

L1—2 millihenries
L2—106 millihenries (tuneable)
L3—106 millihenries (tuneable)

INTEGRATED CIRCUITS

U11—Harris HI506
U12—Harris HI506
U13—Harris HI506
U14 and U25-U32—These are all operational amplifiers manufactured by Texas Instruments and identified as TL-082. These operational amplifiers all operate at a voltage of +15 volts, applied to pin 8, and −15 volts, applied to pin 4. These amplifiers are integrated as two amplifiers on a single chip and when both amplifiers are used the first amplifier receives the more positive input at pin 3 and the more negative input at pin 2 and the output is taken at pin 1 while the second amplifier receives the more positive input at pin 5 and the more negative input at pin 6 and the output is taken at pin 7. When only one amplifier on the chip is used the more positive input is applied to pin 5 and the more negative input is applied to pin 6 while the output is taken at pin 7.
U15—54L00 (standard designation)
U16—Motorola 14520
U17—Motorola 14022
U18—Motorola 14022
U19—Motorola 14013
U20—Motorola 14042
U21—Motorola 14042
U22—Motorola 14013
U23—Motorola 14020
U24—Siliconics DG243

The pin connections for these circuits are identified in the drawings. Equivalent circuits are made by other manufacturers and can be identified in standard reference manuals.

TRANSISTORS

Q3—2N3799 NPN
Q4—2N3799 NPN
Q5—2N3799 NPN
Q6—2N3117 PNP
Q7—2N3117 PNP
Q8—2N3117 PNP
Q9—2N4391 field effect transistor

DIODES

D17—IN914; D21—IN914
D18—IN914; D22—IN914
D19—IN914; D23—IN914
D20—IN752A; D24—IN914

The various blocks described in FIG. 6 are shown in dashed outline in FIG. 12.

It will be appreciated from the foregoing description that the invention provides a novel and improved method and apparatus for detecting the responses produced by saturable targets in the presence of alternating magnetic interrogation fields and that, with the invention, the effects of the earth's magnetic field as well as the intensity of the field needed to saturate targets and other metallic objects are utilized in a novel manner to distinguish targets which saturate at low magnetic fields from other metal objects which saturate only at higher magnetic fields.

I claim:

1. A method of detecting the presence of targets in the interrogation zone of an alternating magnetic field type theft detection apparatus, said targets comprising elements capable, when in said interrogation zone, of being driven alternately into and out of magnetic saturation by an alternating magnetic interrogation field in said zone, said method comprising the steps of generating in said interrogation zone an alternating magnetic interrogation field at an interrogation frequency and at an amplitude sufficient to drive targets in said zone alternately into and out of magnetic saturation so that the targets disturb said alternating magnetic interrogation field in a manner to produce alternating magnetic fields at frequencies which are harmonics of the frequency of said alternating magnetic interrogation field, detecting the alternating magnetic fields in said interrogation zone and producing a corresponding first electrical signal whose amplitude varies according to the intensity of said alternating magnetic fields in said interrogation zone, dividing said first electrical signal according to a series of successive time increments, several of which occur during each cycle of said interrogation frequency, comparing the amplitudes of the first electrical signals which occur during each of a first group of said time increments with the amplitudes of the first electrical signals which occur during corresponding ones of a second group of said time increments, each of said time increments being synchronous with said interrogation frequency, thereby to produce an alarm signal and actuating an alarm in response to said alarm signal.

2. A method according to claim 1 wherein said alarm is produced in response to said alarm signal exceeding a predetermined value relative to the amplitude of said first electrical signal.

3. A method according to claim 2 wherein said alarm is produced in response to said alarm signal exceeding, in said several successive half cycles of said interrogation frequency, the predetermined value relative to the amplitude of said first electrical signal.

4. A method according to claim 2 wherein, prior to dividing said first electrical signal, its amplitude variations are changed by an amount inversely proportional to the magnitude of preceeding increases in amplitude of the signal which occurred within the preceeding several half cycles of said interrogation frequency.

5. A method according to claim 2 wherein said alarm signal and said first electricl signal are each integrated over several successive half cycles of said interrogation frequency to produce integrated alarm signals and integrated first electrical signals and wherein said alarm is produced in response to said integrated alarm signal attaining said predetermined value relative to said integrated first electrical signal.

6. A method according to claim 5 wherein only those portions of said alarm signal and said first electrical signal which occur when said magnetic interrogation field is at less than maximum intensity are integrated to produce said said intrgrated alarm signals and integrated first electrical signals.

7. A method according to claim 1 wherein said first electrical signal is divided according to said series of successive time increments by switching said signal successively for individually storing the amplitudes of the signal which occur during the different time increments.

8. A method according to claim 7 wherein said switching is carried out in synchronism with said interrogation frequency.

9. A method according to claim 8 wherein said groups of time increments occur in successive half cycles of said interrogation frequency.

10. A method according to claim 7 wherein the amplitudes of the signal which occur during each of said first group of successive time increments are stored as voltages in associated capacitors and wherein the amplitudes of the signal which occur during the corresponding ones of each of said second group of successive time increments are also applied as voltages to said capacitors.

11. A method according to claim 1 wherein said comparison is made by algebraically combining the amplitudes of the electrical signal which occur during said time increments.

12. A method according to claim 11 wherein, prior to dividing said first electrical signal, its amplitude variations are changed by an amount inversely proportional to the magnitude of preceeding increases in amplitude of the signal.

13. A method according to claim 12 wherein said amplitude variations are changed only in response to the magnitude of said preceeding increases exceeding a predetermined threshold.

14. A method according to claim 11 wherein the amplitudes of the first electrical signals are compared for corresponding time increments in several successive half cycles of said interrogation frequency.

15. A method according to claim 1 wherein the corresponding ones of said second group of time increments are separated in time by one-half cycle of said interrogation frequency from their respective time increments in said first group.

16. A method according to claim 15 wherein said comparison is made by algebraically combining the amplitudes of the signals which occur during said time increments.

17. A method according to claim 16 wherein the amplitudes of the signal which occur during each of said first group of successive time increments are stored for a duration of one-half period of said interrogation frequency to be compared with the amplitudes which occur during each of said second group of successive time increments.

18. A method of detecting the presence of targets in the interrogation zone of an alternative magnetic field type theft detection apparatus, said targets comprising elements capable, when in said interrogation zone, of being driven alternately into and out of magnetic saturation by an alternating magnetic interrogation field in said zone, said method comprising the interrogation field in said zone, said method comprising the steps of maintaining throughout said zone a steady, substantially uniform magnetic biasing field, generating in said zone an alternating magnetic interrogation field at an interrogation frequency and of sufficient intensity to drive targets in said zone alternately into and out of magnetic saturation so that the target disturbs said alternating magnetic interrogation field in a manner to produce alternating magnetic fields at frequencies which are harmonics of the frequency of said alternating magnetic interrogation field, producing first electrical signals in response to alternating magnetic fields in said interrogation zone, producing, in response to said first electrical signals, further signals having an amplitude corresponding to the effect of said magnetic bias, said amplitude being substantially independent of the total amplitude of said first electrical signals, comparing said first electrical signals without said processing and said further signals and producing an alarm signal in response to a predetermined relationship between said first and further signals.

19. A method according to claim 18 wherein said first electrical signals are produced in response to alternating magnetic fields in said interrogation zone which are greater in frequency than said interrogation frequency.

20. A method according to claim 19 wherein said step of processing said first electrical signals is carried out by sampling the amplitudes of the signal in several successive time increments during each period and in synchronism with said interrogation frequency and algebraically combining each sampled amplitude with amplitudes sampled at times displaced therefrom by one-half periods of said interrogation frequency.

21. A method according to claim 19 wherein said first electrical signals are produced in response to alternating magnetic fields in said interrogation zone which are synchronous with said interrogation frequency.

22. A method according to claim 21 wherein said step of processing said first electrical signals comprises extracting from said signals the component thereof which corresponds to their asymmetry.

23. A method according to claim 18 wherein said step of processing said first electrical signals comprises dividing said signals into several successive time increments synchronized to said interrogation frequency and comparing the portions of said electrical signal which occur in corresponding time increments in successive half cycles of said interrogation frequency.

24. A method according to claim 23 wherein said step of processing said first electrical signals further comprises switching said signals into separate signal storage means during each of said successive time increments which occur in one-half cycle of said interrogation frequency and thereafter, during the next half cycle of said interrogation frequency comparing the signals which occur during each time increment with the signal stored in the corresponding storage means.

25. A method according to claim 18 wherein said signals are compared by combining said signals algebraically.

26. A method according to claim 25 wherein the step of comparing said first electrical signals and said further signals is carried out by comparing the amplitudes of said signals.

27. A method according to claim 26 wherein the step of comparing said first electrical signals and said further signals is carried out by comparing the values of said first electrical signals which occur in several successive half cycles of said interrogation frequency with the values of said further electrical signals which occur in several successive half cycles of said interrogation frequency.

28. A method according to claim 26 wherein only the values of the first electrical signals which occur when the alternating magnetic interrogation field is less than a first predetermined intensity and only the values of said further signals which occur when the alternating magnetic interrogation field is less than a second predetermined intensity are compared in said step of comparing.

29. A method according to claim 28 wherein said first and second predetermined intensities are less than the maximum intensity of said alternating magnetic field.

30. A method according to claim 28 wherein the step of comparing said first electrical signals and said further signals is carried out by comparing the values of said first electrical signals which occur in several successive half cycles of said interrogation frequency with the values of said further electrical signals which occur in several successive half cycles of said interrogation frequency.

31. A method according to claim 26 wherein the step of producing said alarm signal is carried out in response to the ratio of the amplitude of said further signals to the amplitude of said first electrical signals exceeding a predetermined value.

32. A method according to claim 31 wherein said further signals are amplified in a signal amplification device whose gain is said predetermined value and wherein said alarm signal is produced when the amplitude of the thus amplified further signals exceeds the amplitude of the first electrical signals by a predetermined amount.

33. Alternating magnetic field type theft detection apparatus for detecting the presence of targets in an interrogation zone, said targets comprising elements capable, when in said interrogation zone of being driven alternately into and out of magnetic saturation by an alternating magnetic interrogation field in said zone, said apparatus comprising means for generating an alternating magnetic interrogation field in said interrogation zone at an interrogation frequency and at an amplitude sufficient to drive targets in said zone alternately into and out of magnetic saturation, magnetic field detection means arranged to detect the alternating magnetic fields in said interrogation zone and to produce a corresponding first electrical signal whose amplitude varies according to the intensity of the alternating magnetic fields in said interrogation zone, averager means including switch means arranged to be operated in synchronism with said generating means and connected to said detection means to divide said first electrical signal according to a series of successive time increments, several of which occur during each cycle of said interrogation frequency, comparison means arranged in conjunction with said switch means for comparing the amplitudes of the first electrical signal which occur during each of a first group of said time increments with the amplitudes of the first electrical signal which occur during corresponding ones of a second group of time increments, each of said time increments being in synchronism with said interrogation frequency and means for activating an alarm in response to a predetermined output from said comparison means.

34. Theft detection apparatus according to claim 33 wherein said comparison means is constructed to algebraically combine the amplitudes of the electrical signal which occur during said time increments.

35. Theft detection apparatus according to claim 33 wherein said comparision means comprises a plurality of storage elements each associated with a different time increment.

36. Theft detection apparatus according to claim 35 wherein said storage elements are capacitors.

37. Theft detection apparatus according to claim 36 wherein said switch means comprises a plurality of switches each arranged to connect a different capacitor to said magnetic field detection means.

38. Theft detection apparatus according to claim 37 wherein said means for generating an alternating magnetic field includes an oscillator which operates at a frequency several times higher than said interrogation frequency and frequency divider means connected to said oscillator to produce said interrogation frequency and wherein said frequency divider means is also connected to said switch means to operate each switch to connect a different capacitor in succession to said magnetic field detection means, whereby different capacitors receive said first electrical signal during different successive time intervals in each cycle of said alternating magnetic interrogation field and in sychronism therewith.

39. Theft detection apparatus according to claim 38 wherein said frequency divider means and said switch means are arranged such that said plurality of storage elements are connected to receive said electrical signal during successive time increments in one-half cycle of said alternating magnetic interrogation field.

40. Theft detection apparatus according to claim 39 wherein said frequency divider means and said switch means are further arranged such that said plurality of storage elements are connected also to receive said electrical signal during corresponding successive time increments in successive half cycles of said alternating magnetic interrogation field.

41. Theft detection apparatus according to claim 33 wherein said means for actuating an alarm in response to said predetermined output from said comparison means comprises a further comparison means connected to receive outputs from the first comparison means and from said magnetic field detection means.

42. Theft detection apparatus according to claim 41 wherein said further comparison means includes an amplifier connected to amplify inputs thereto from said first comparison means.

43. Theft detection apparatus according to claim 42 wherein a signal compressor is connected between said magnetic field detection means and said averager means for changing the amplitude variations of said first electrical signal by an amount inversely proportional to the magnitude of preceeding amplitudes of the signal.

44. Theft detection apparatus according to claim 43 wherein said signal compressor means comprises a variable gain amplifier whose gain is inversely proportional to the amplitude of said first electrical signal.

45. Theft detection apparatus according to claim 44 wherein said further comparison means comprises means to integrate the signals from said first comparison means and the signals from said magnetic detection means over several half cycles of said magnetic interrogation field and to compare the integrated signals.

46. Theft detection apparatus according to claim 45 wherein said further comparision means comprises signal gates connected to be operated in synchronism with said means for generating an alternating magnetic field and arranged to exclude from comparison those signals from said first comparision means and from said magnetic field detection means which occur during the intervals when the interrogation magnetic field is at maximum intensity.

47. Alternating magnetic field type theft detecting apparatus for detecting the presence of targets in an interrogation zone, said targets comprising elements capable, when in said interrogation zone, of being driven alternately into and out of magnetic saturation by an alternating magnetic interrogation field in said zone, said apparatus comprising alternating magnetic interrogation field generating means arranged to generate in said interrogation zone an alternating magnetic interrogation field at an interrogation frequency and at an intensity sufficient to drive targets in said zone alternately into and out of magnetic saturation, alternating magnetic field detection means arranged to detect the presence of alternating magnetic fields in said interrogation zone and to produce corresponding first electrical detection signals, signal processing means connected to said alternating magnetic field detection means to produce further signals having an amplitude corresponding to the effects produced on said targets by a uniform continuous magnetic bias, said amplitude being substantially independent of the total amplitude of said first electrical signals, comparison means connected to said magnetic field detection means and to said signal processing means to compare said first electrical detection signals which have not been processed by said processing means and said further signals and an alarm actuation means connected to said comparison means and operative to produce an alarm upon a predetermined relationship between said first and further electrical signals.

48. Theft detection apparatus according to claim 47 wherein said comparision means includes integrators constructed and connected to integrate the values of said first and further signals over several half cycles of said interrogation frequency.

49. Theft detection apparatus according to claim 47 wherein said magnetic field detection means is arranged to detect magnetic fields which vary in a predetermined frequency.

50. Theft detection apparatus according to claim 49 wherein said signal processing means is constructed to produce said further signals in synchronism with said interrogation frequency.

51. Theft detection apparatus according to claim 47 wherein said signal processing means is constructed to produce said further signals corresponding to the effects of the earth's magnetic field on said targets.

52. Theft detection apparatus according to claim 51 wherein said signal processing means is constructed to produce said further signals by detection of the asymmetry of said first electrical detection signals.

53. Theft detection apparatus according to claim 47 wherein said signal processing means includes a signal averager which is constructed to divide said first electrical signals into several successive time segments within each cycle of said interrogation frequency and synchronized therewith and to compare the portions of said electrical signal which occur in corresponding time segments in successive half cycles of said interrogation frequency.

54. Theft detection apparatus according to claim 53 wherein said signal processing means further includes a compressor which is constructed and connected to subject said first electrical signals to a gain which is inversely proportional to their amplitudes and to supply the thus subjected signals to said averager.

55. Theft detection apparatus according to claim 54 wherein said compressor comprises a variable gain amplifier connected to receive said first electrical signals and a rectifier and integrator connected to receive the output of said variable gain amplifier, the output of said rectifier and integrator being connected to adjust the gain of said variable gain amplifier and the output of said variable gain amplifier being connected to said averager.

56. Theft detection apparatus according to claim 55 wherein said integrator has a rapid rise time constant and a slower fall time constant.

57. Theft detection apparatus according to claim 56 wherein the fall time constant of said integrator extends over several cycles of the interrogation frequency.

58. Theft detection apparatus according to claim 53 wherein said signal processing means includes switches and storage elements, said switches being constructed and arranged to be closed sequentially and alternately in synchronism with said interrogation frequency and connected so that, when closed, each switch applies said first electrical signal to its respective storage element.

59. Theft detection apparatus according to claim 58 wherein said switches are each arranged to be closed once in each half cycle of said interrogation frequency in a predetermined sequence.

60. Theft detection apparatus according to claim 59 wherein said storage means are capacitors to which corresponding portions of said first electrical signal are applied once in each half cycle of said interrogation frequency so that said portions are combined algebraically.

61. Theft detection apparatus according to claim 47 wherein said comparison means includes gating means synchronized with said alternating magnetic interrogation field generating means to exclude from comparison those signals generated when the magnetic interrogation field is at its maximum intensity.

62. Theft detection apparatus according to claim 61 wherein said gating means includes separate gates connected to gate the passage of said first electrical signals and said further signals respectively, to said comparison means.

* * * * *